US010309595B1

(12) United States Patent
Datz et al.

(10) Patent No.: US 10,309,595 B1
(45) Date of Patent: Jun. 4, 2019

(54) LED BEACONS

(71) Applicant: STAR HEADLIGHT & LANTERN CO., INC., Avon, NY (US)

(72) Inventors: R. Michael Datz, Greece, NY (US); Andrew T. Mack, Livonia, NY (US)

(73) Assignee: Star Headlight & Lantern Co., Inc., Avon, NY (US)

( * ) Notice: Subject to any disclaimer, the term of this patent is extended or adjusted under 35 U.S.C. 154(b) by 0 days.

(21) Appl. No.: 16/040,146

(22) Filed: Jul. 19, 2018

Related U.S. Application Data

(60) Provisional application No. 62/534,521, filed on Jul. 19, 2017.

(51) Int. Cl.

| | |
|---|---|
| ***F21S 9/02*** | (2006.01) |
| ***F21S 9/03*** | (2006.01) |
| ***F21V 5/04*** | (2006.01) |
| ***F21V 5/02*** | (2006.01) |
| ***F21V 13/02*** | (2006.01) |

(52) U.S. Cl.
CPC ..... *F21S 9/022* (2013.01); *F21S 9/037* (2013.01); *F21V 5/02* (2013.01); *F21V 5/04* (2013.01); *F21V 13/02* (2013.01)

(58) Field of Classification Search
CPC ..... F21S 9/022; F21V 13/02; F21V 5/04
See application file for complete search history.

(56) References Cited

U.S. PATENT DOCUMENTS

| | | | |
|---|---|---|---|
| 3,221,162 | A | 11/1965 | Heenan et al. |
| 5,224,773 | A | 7/1993 | Arimura |
| 5,237,490 | A | 8/1993 | Ferng |
| 5,436,535 | A | 7/1995 | Yang |
| 5,585,783 | A | 12/1996 | Hall |
| 5,642,933 | A | 7/1997 | Hitora |
| 5,688,042 | A | 11/1997 | Madadi et al. |
| 5,694,112 | A | 12/1997 | Vannrox et al. |
| 5,806,965 | A | 9/1998 | Deese |
| 5,890,794 | A | 4/1999 | Abtahi et al. |
| 5,929,788 | A | 7/1999 | Vukosic |

(Continued)

OTHER PUBLICATIONS

Star Headlight & Lantern Co., Inc., C2 LED Series, 2016.

(Continued)

*Primary Examiner* — Donald L Raleigh

(74) *Attorney, Agent, or Firm* — Kenneth J. LuKacher; Kenneth J. LuKacher Law Group

(57) ABSTRACT

An LED beacon has a base and four vanes upon the base extending radially outward from a central axis which lies perpendicular to an upper surface of the base. The vanes are formed using two circuit boards that intersect each other at a right angle, in which each of the circuit boards provides two of the vanes extending outwards in opposite directions from the central axis. Each vane has two opposing surfaces, and upon each such surface are mounted, in proximity to the central axis, one or more LEDs producing same color or different colors of light. A controller enables the LEDs to output light in multiple modes of solid on, flashing and/or rotating patterns along the 360 degree extent of a lens upon the base, and substantially along the height of the lens, for projection preferably as collimated light. LED beacons thus having mono-color and multicolor operation are provided.

20 Claims, 19 Drawing Sheets

(56) References Cited

U.S. PATENT DOCUMENTS

| | | | | |
|---|---|---|---|---|
| 6,086,220 | A | 7/2000 | Lash et al. | |
| 6,183,100 | B1 | 2/2001 | Suckow et al. | |
| 6,380,865 | B1 | 4/2002 | Pederson | |
| 6,425,678 | B1 | 7/2002 | Verdes et al. | |
| 6,483,254 | B2 | 11/2002 | Vu et al. | |
| 6,483,439 | B1 | 11/2002 | Vukosic | |
| 6,626,557 | B1 | 9/2003 | Taylor | |
| 6,667,582 | B1 | 12/2003 | Procter | |
| 6,844,824 | B2 | 1/2005 | Vukosic | |
| 6,991,351 | B1 | 1/2006 | Petrick | |
| 7,252,405 | B2 | 8/2007 | Trenchard et al. | |
| 7,534,009 | B2 | 5/2009 | Trojanowski et al. | |
| 8,662,702 | B2 | 3/2014 | Datz et al. | |
| 8,840,268 | B2 | 9/2014 | Datz et al. | |
| 2002/0048174 | A1 | 4/2002 | Pederson | |
| 2004/0156210 | A1 | 8/2004 | Pederson | |
| 2005/0110649 | A1 | 5/2005 | Fredericks et al. | |
| 2006/0132323 | A1 | 6/2006 | Grady, Jr. | |
| 2006/0181879 | A1 | 8/2006 | Pederson | |
| 2008/0088477 | A1 | 4/2008 | Martin et al. | |
| 2010/0244748 | A1 | 9/2010 | Haab et al. | |
| 2014/0160744 | A1* | 6/2014 | Wimberly | F21V 13/04 362/232 |
| 2017/0184257 | A1* | 6/2017 | Belitz | F21V 5/045 |

OTHER PUBLICATIONS

Star C2 LED Beacons, YouTube Screen Printout, Sirennet, Oct. 27, 2014.

ECCO Safety Group, ECCO(R) 2016 Product Guide, ECCO(R) Beacons LED, pp. 22-23, 2016.

* cited by examiner

LED BEACONS

This application claims priority to U.S. Provisional Patent Application No. 62/534,521, filed Jul. 19, 2017, which is incorporated herein by reference.

FIELD OF THE INVENTION

The present invention relates to LED beacons, and particularly to LED beacons having illumination provided by LEDs mounted upon radially disposed vanes within the beacon. The present invention is useful in that the vanes can be provided by two intersecting circuit boards having the electronics for the beacon, where heat from operation of the LEDs on such vanes can readily dissipate into the ambient air within the LED beacon, thereby avoiding the need for additional heat transfer material along the circuit boards to promote conduction of heat away from the LEDs of prior art LED beacons. The LEDs may emit light of the same color to provide an LED beacon having mono-color operation, or light of different colors to provide an LED beacon having multiple selectable colors of operation.

BACKGROUND OF THE INVENTION

Light beacons have been provided with Fresnel collimating lenses which provide cylindrical beams from one or more light sources located centrally in the collimating lens on a raised structure, such as described for example in U.S. Pat. No. 3,221,162, issued Nov. 30, 1965 to Heenan et al, U.S. Pat. No. 6,425,678, issued Jul. 30, 2002, to Verdes et al., and U.S. Pat. No. 5,237,490, issued Aug. 17, 1993, to Ferng. It is important that the light from the one or more light sources fills the collimating lens of the beacon so that light from the collimating lens will exit the beacon having the desired output performance while satisfying any regulatory output requirements.

Improved optical systems have been developed to assist in directing illumination to the collimating lens using multiple LEDs mounted on different sides of a post. Such mounted LEDs direct illumination along different angles towards a cylindrical Fresnel lens via focus shifting optics, such as described in U.S. Pat. No. 8,662,702 of Mar. 4, 2014, and U.S. Pat. No. 8,840,268 of Sep. 23, 2014, both to Datz et al. However, mounting on such post is complex in that it requires four vertically disposed circuit boards with LEDs at a desired height in the beacon. Mounting further requires multiple pads of heat conductive material to carry heat away from the LEDs down to the beacon's base in order to ensure reliable LED operation. Thus, it would be desirable to provide an LED beacon with a raised structure that improves management of LED generated heat so as to avoid the need for heat transfer material along circuit boards, while assuring proper filling of the beacon's lens with LED light.

SUMMARY OF THE INVENTION

Accordingly, a principal object of the present invention is to provide LED beacons having LEDs mounted upon radially disposed vanes to convey light outwards to a lens providing the dome of the beacon.

It is a further object of the present invention to provide LED beacons having LEDs mounted upon radially disposed vanes each having opposing surfaces with LEDs providing light of one color or different colors.

A still further object of the present invention is to provide LED beacons having LEDs mounted upon four radially disposed vanes each having opposing surfaces with LEDs having one or more modes of operation of solid on, flashing patterns, and/or simulation of rotating motion of light along the 360 degree extent of the beacon's lens for projection from the beacon.

Briefly described, the present invention embodies an LED beacon having a base, a lens providing a dome over the base, and four vanes upon the base extending radially outwards from a central axis, which lies perpendicular to an upper surface of the base. Each of the vanes has two opposing surfaces, and upon each opposing surface is mounted at least one of a plurality of LEDs in proximity to the central axis to convey light outward from the beacon via the lens. The LEDs are disposed along the vanes so that the combination of light from the LEDs can be activated to convey light in 360 degrees to substantially cover the lens, or sequentially activated along the 360 extent of the lens to simulate rotating light. The lens projects the light received from the LEDs outwards from the beacon as warning signals.

The LEDs may be mounted upon each of two opposing surfaces of the vanes at a common height from the base, which is preferably approximately midway along a height of the lens from the base. Further, the lens of the beacon preferably collimates the light from the LEDs, and thus is referred to herein as a collimating lens. When the lens is a collimating lens, the common height at which LEDs may be mounted is in accordance with the focal point of the collimating lens which lies along the central axis. Other lenses than those providing collimation may optionally be used.

The vanes are formed by two circuit boards upon the base that intersect each other at a right angle at the central axis, in which each of the circuit boards provides two of the vanes extending outwards in opposite directions from the central axis. Wires extend via the base for connection to one of the vanes associated with a first circuit board to enable operation of electronics along the first circuit board and the LEDs disposed thereupon, and a second circuit board has electronics electrically connected to the electronics on the first circuit board to enable operation of the electronics on the second circuit board and the LEDs disposed thereupon. The electronics include a controller, such as a microcontroller or microprocessor, on one of the circuit boards which selectively enables the LEDs of the beacon to output light in different modes of at least solid on and flashing patterns along the 360 degree extent of the lens for projection from the beacon. Preferably, the controller can further operate the LEDs in a rotating mode, such as by continuously sequentially activating four different sets of LEDs, where each of the sets face a different direction at 0, 90, 180, and 270 degrees, respectively, about the beacon's central axis to simulate a rotating pattern of light from the beacon. Each of such sets of LEDs comprises LEDs along two different vanes that extend in opposite directions from the central axis, and face a common direction at either 0, 90, 180, or 270 degrees.

In one embodiment, a different one of the LEDs is mounted upon the four vanes along each of their two opposing surfaces in proximity to the central axis, so that a total of eight LEDs are mounted on the vanes. Each of the LEDs in such case may emit the same color of light to provide an LED beacon having mono-color operation. In another embodiment to provide an LED beacon having multicolor operation, the LEDs provide different colors of lights, and at least one of the LEDs of each different color are mounted upon the four vanes along each of their two opposing surfaces in proximity to the central axis. For example, two LEDs providing different colors of light when activated may be provided on each of the two opposing surfaces of each of the vanes of the beacon. This provides eight LEDs of each color in the beacon and thus a total of sixteen LEDs mounted on the vanes. The controller responsive to selection of one or both colors, operates LEDs of such color accordingly, such as in solid on, flashing, or rotating modes, thereby enabling selective activation of LEDs associated with each of the different colors.

While a single group of LEDs are mounted on the vanes at a common height from the base, alternatively, multiple groups of LEDs may be provided along the vanes, where each group is mounted to the circuit boards providing the vanes at a different height from the base in order to provide additional or different illumination to the lens for projection from the beacon. Such groups when numbering more than two may be equally or unequally staggered up and down along the vanes as desired.

The profile of the outer side edge of the vanes can be selected to provide a desired passage of light from LEDs to the lens for the particular application of the beacon. For example, to minimize dark or dimmed areas along lens that could be caused by vanes blockage of LED light, the vanes can each have an outer side edge with an angled opening disposed at a tilt with respect to the central axis to promote passage of light from the LEDs when activated. In another example, no such openings are present along the vanes, and the profile of the outer side edges of each vane extends along a dimension generally parallel to the central axis along at least a portion of the vane starting at a height lower than the height of the LEDs from the base to a top of the vane.

The present invention further embodies a method for providing an LED beacon having the steps of: mounting four vanes upon a base extending radially outward from a central axis which lies perpendicular to an upper surface of the base; providing on each of two opposing surfaces of the vane one or more LEDs emitting one or more different colors of light in proximity to the central axis; and selectively activating the LEDs to output light in each of the one or more colors via a lens. Such vanes preferably number four, and such mounting further has the step of forming the vanes using two circuit boards upon the base that intersect each other at a right angle, in which each of the circuit boards provides two of the vanes extending outwards in opposite directions from the central axis.

BRIEF DESCRIPTION OF THE DRAWINGS

The foregoing and other objects and advantages of the invention will become more apparent from a reading of the following description in connection with the accompanying drawings in which:

FIG. 9A shows the electronics of a first circuit board, and FIG. 9B shows the electronics on a second circuit board which connects to the electronics on the first circuit board;

FIG. 10A shows the electronics of a first circuit board, and FIG. 10B shows the electronics on a second circuit board which connects to the electronics on the first circuit board;

FIG. 13A shows the electronics of a first circuit board, and FIG. 13B shows the electronics on a second circuit board which connects to the electronics on the first circuit board;

DETAILED DESCRIPTION OF THE INVENTION

Figure 1:
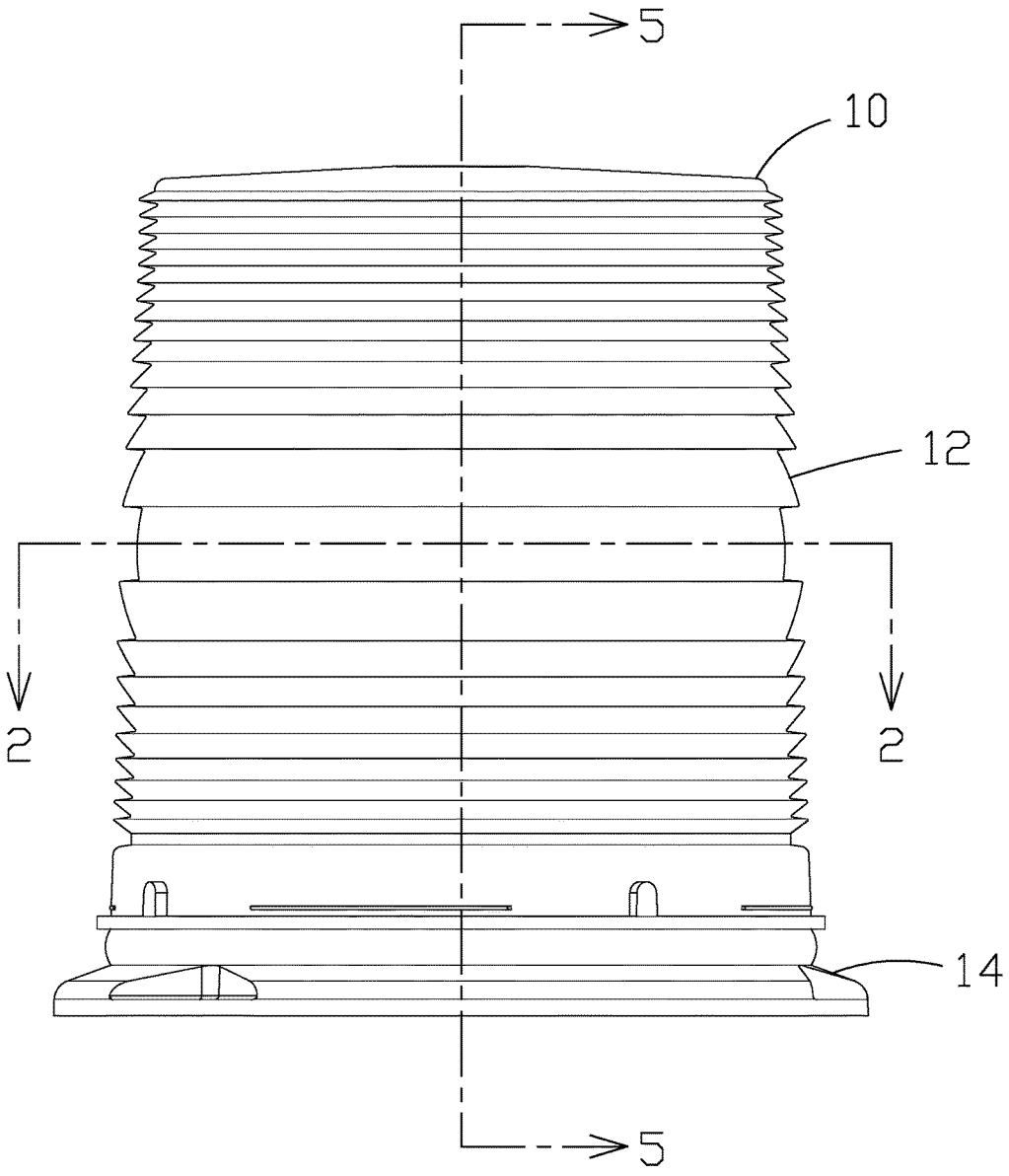
FIG. 1 is a front view of an LED beacon embodying the present invention.
Figure 2:
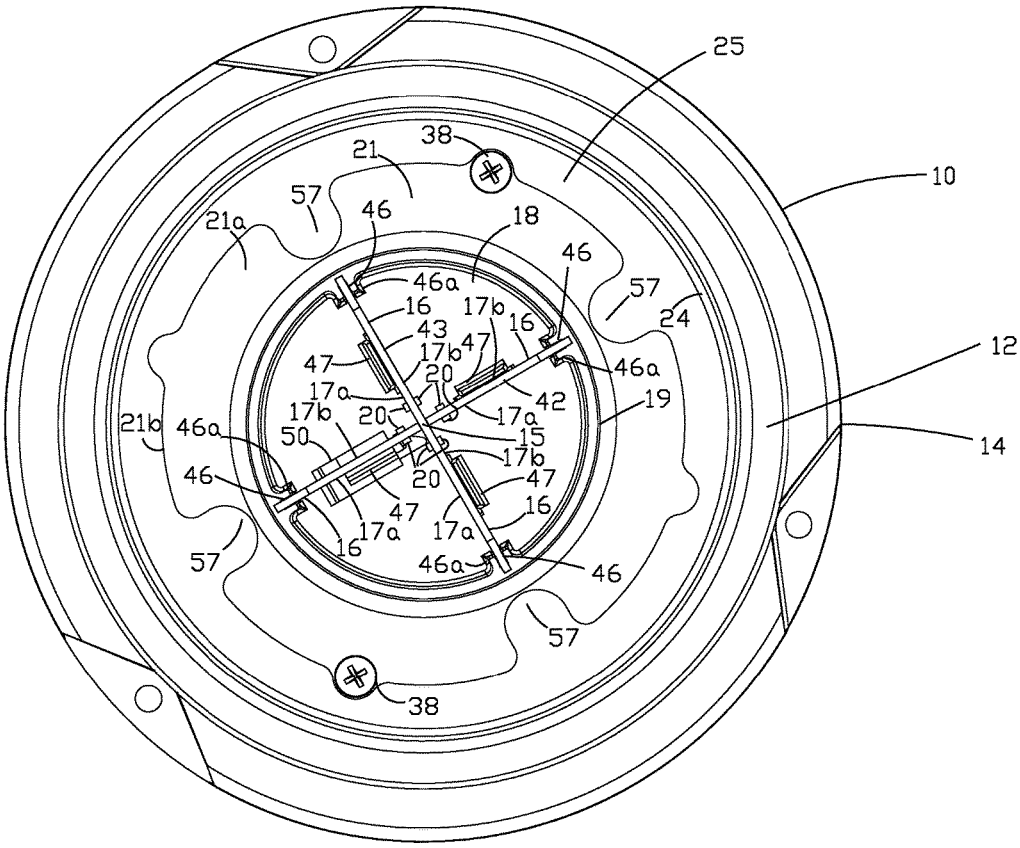
FIG. 2 is a horizontal sectional view of the LED beacon along line 2-2 in FIG. 1 in the direction of the arrows at the end of the section line.

Referring to FIG. 1, an LED beacon 10 embodying the invention is shown with a projecting element in the form of a Fresnel collimating lens 12 on a base 14, where lens 12 provides the dome of the beacon with a closed top end. The lens 12 may be same or similar to the collimating lens shown and described in the above-referenced Datz et al., U.S. Pat. Nos. 8,662,702, and 8,840,268, or as utilized in Star Halo® LED Beacons manufactured by Star Headlight and Lantern, Co. of Avon, New York, USA. Lens 12 may be clear, or of molded colored plastic material, such as red or amber.

Figure 3:
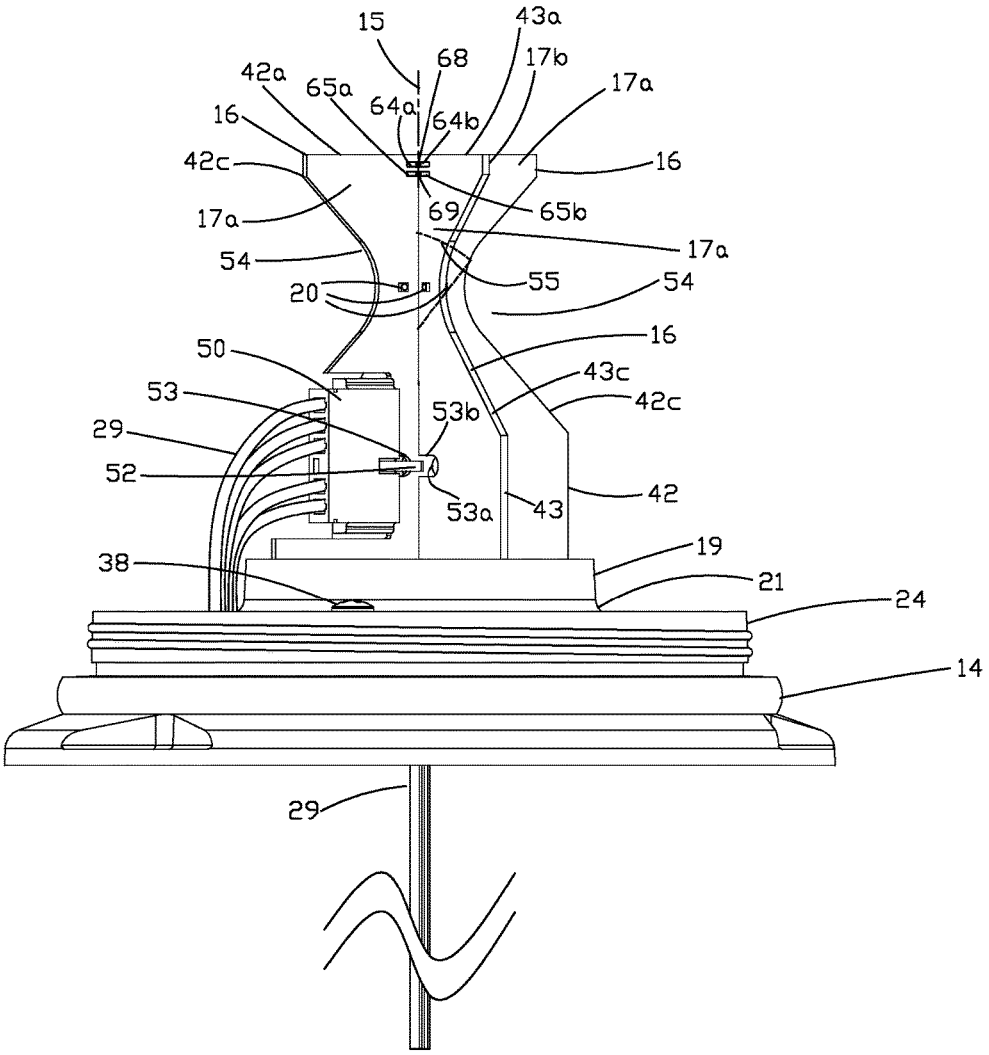
FIG. 3 is a side view of the LED beacon of FIG. 1 with the collimating lens providing the dome of the beacon removed.
Figure 4:
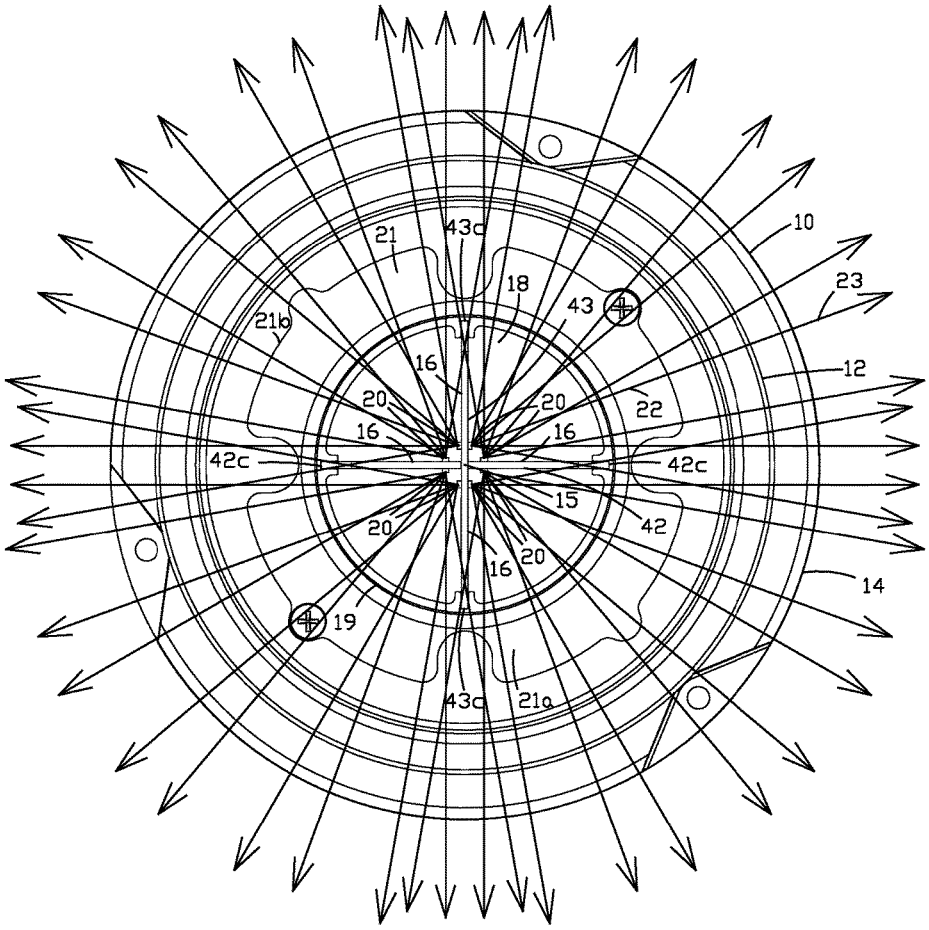
FIG. 4 is the same horizontal sectional view as FIG. 2 depicting light rays showing the propagating of light from the LEDs disposed upon vanes within the beacon in 360 degrees.
Figure 5:
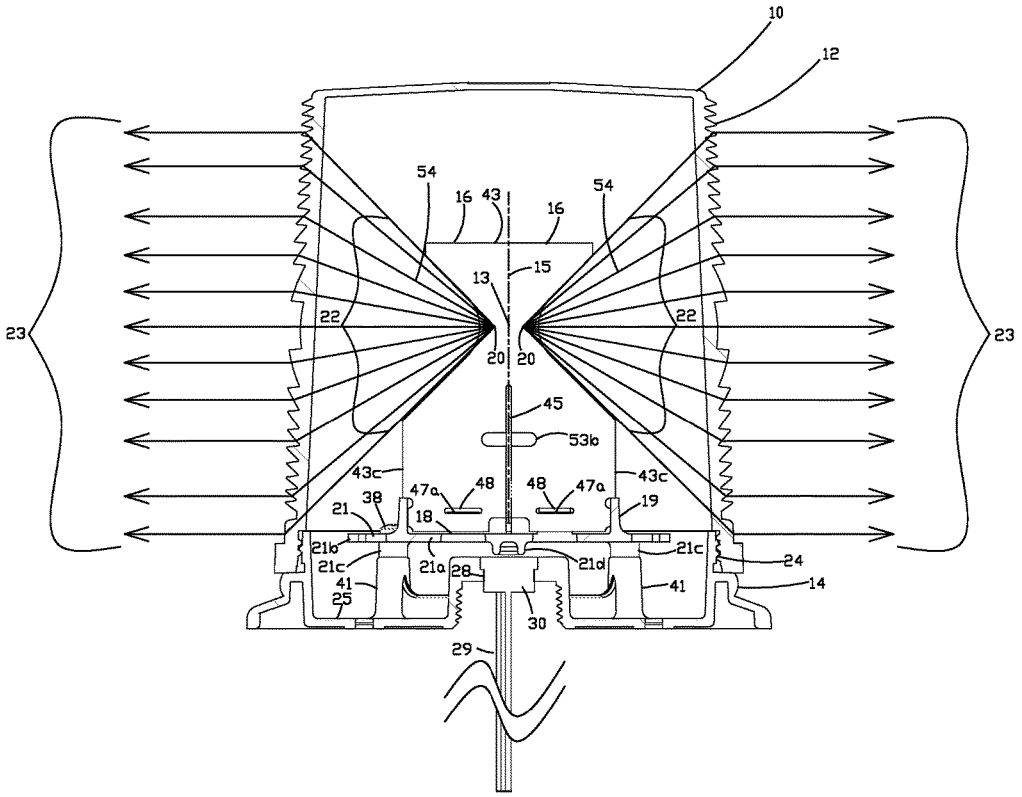
FIG. 5 is a vertical sectional view of the LED beacon along line 5-5 of FIG. 1 in the direction of the arrows at the end of the section line depicting light rays showing the propagating of light from the LEDs of the beacon.

Referring to FIGS. 2, 3, 4, and 5, within beacon 10 are four vanes 16 extending upwards from base 14 and radially spaced equally about a virtual central axis 15 which lies perpendicular to an upper surface 18 of base 14 below such vanes 16. The four vanes 16 extends at 0, 90, 180, and 270 degrees about the central axis 15, respectively, within a circular wall 19 extending upwards from upper surface 18 of base 14. Each vane 16 has two opposing surfaces 17*a* and 17*b* which face collimating lens 12 in opposite directions. Upon each of surfaces 17*a* and 17*b* of each vane 16 is mounted one of eight LEDs (light-emitting diodes) 20 in proximity to (or adjacent) central axis 15 at the same height above base 14 so that light 22, depicted by light rays from LEDs 20, propagates toward collimating lens 12 approximately in focus for projection from the beacon 10. Light 22 from LEDs 20 is approximately in focus with lens 12, since each LED 20 is slightly offset from a focal point 13 of lens 12 along central axis 15, as best shown in FIG. 5. Thus, LEDs 20 are provided in proximity to central axis 15 at a common height from the base 14 in accordance with focal point 13, where such common height preferably corresponds to the position of section line 2-2 of FIG. 1 which lies approximately midway along a height of lens 12 from base 14. While each surface 17*a* and 17*b* is shown having a single LED 20, each vane 16 may have mounted multiple LEDs 20 along each of its surfaces 17*a* and 17*b* that are at same or different height from base 14, such as shown for example in FIG. 12 or 14, respectively. Further, LEDs may be provided at same, different or scattered heights from base 14 as desired when a different lens than lens 12 with zero or other light refraction properties provides the dome of beacon 10.

As shown in FIGS. 4 and 5, light 22 incident lens 12 is collimated as light 23 illustrated as light rays exiting beacon 10. The combination of light 22 by the LEDs 20 fills, or at least substantially fills, in 360 degrees (as depicted in FIG. 4) along a height of collimating lens 12 (as depicted in FIG. 5). Unlike the LED beacon described in U.S. Pat. Nos. 8,662,702, and 8,840,268 having multiple LED mounted on different sides of a raised post, LEDs 20 are so close to their ideal location of focal point 13 along the central axis 15 that the focus shifting optics as described in these patents are not needed in order to efficiently illuminate collimating lens 12.

Figure 6:
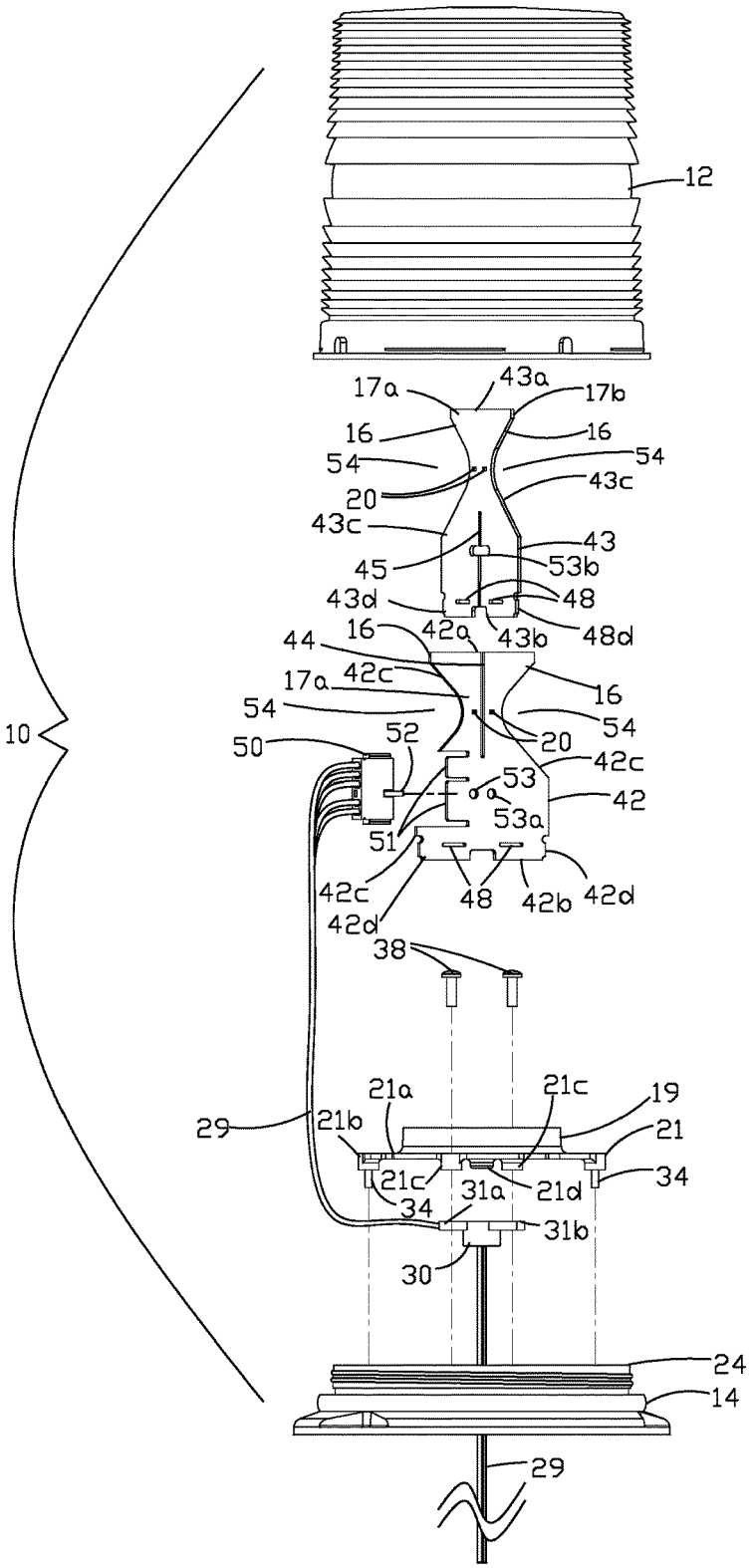
FIGS. 6 and 7 are side and perspective exploded views, respectively, of the LED beacon of FIG. 1.
Figure 7:
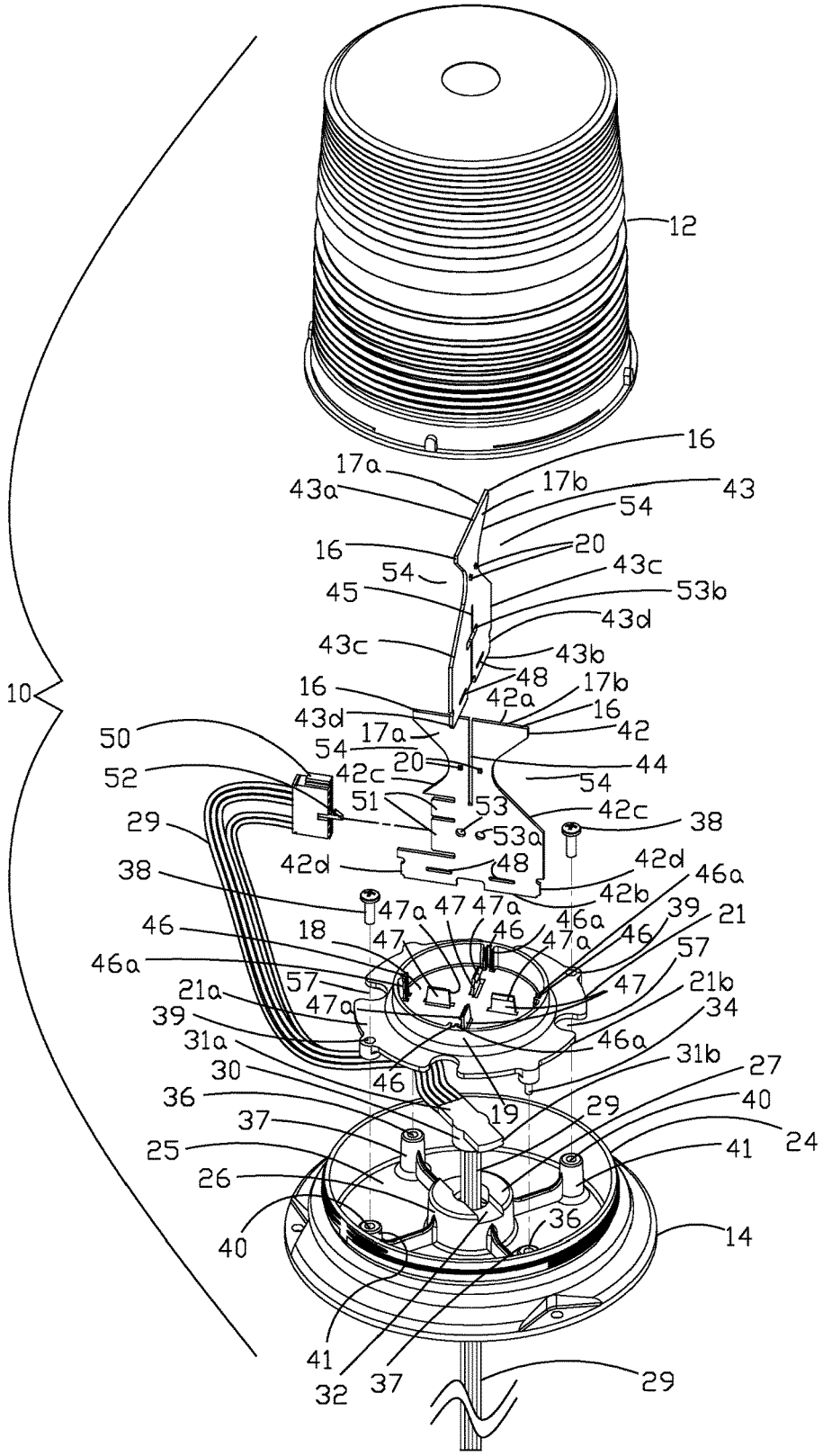
Figure 8:
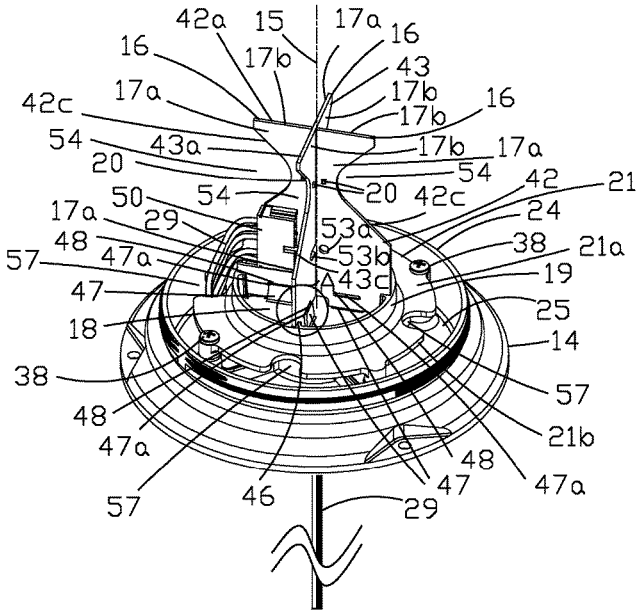
FIG. 8 is a perspective view of the LED beacon of FIG. 1 with the collimating lens providing the dome of the beacon removed.

Referring to FIGS. 6, 7, and 8, the assembly of beacon 10 will now be described. Base 14 may be of plastic, or of metal, such as aluminum or steel, and may be similar to that described in the above-referenced Datz et al. patents or Star Halo® LED Beacons, but structured to have a support bracket or member 21 for vanes 16 received along the interior of a circular wall 24 of base 14 that provides exterior threads for engaging threads along collimating lens 12 for mounting lens 12 onto base 14. Under support bracket 21, along a bottom 25 of base 14, extends a central cylindrical wall or member 26 having a top wall 27 with an opening 28 for extending wires 29 into beacon 10. Wires 29 pass through a cylindrical sealing member 30 which extends into opening 28 and frictionally engages along the interior thereof. Two flanges 31*a* and 31*b* of sealing member 30 extend outwards in opposite directions along the top of sealing member 30 and frictionally engage a slot 32 along top wall 27. Sealing member 30 is of rubber molded over wires 29 to seal opening 28 from the external environment, while orienting wires 29 to bend and extend outward through flange 31*a* as a ribbon of wires 29. Such sealing member 30 may also provide strain relief for such wires 29.

Support bracket 21 may be of molded plastic material, and represents part of base 14 providing circular wall 19 and upper surface 18 upon which vanes 16 are situated. Upper surface 18 represents the upper surface of a wall 21*a* of bracket 21, where circular wall 19 extends upwards from wall 21*a*, and wall 21*a* extends radially outward from the base of circular wall 19 to provide an outer flange 21*b*. Extending downwardly from outer flange 21*b* are pegs 34 that are received into two holes 36 of bosses 37 extending upwards along the interior of bottom 25 of base 14. Two self-tapping screws 38 extend via holes 39 in the outer flange 21*b* of support bracket 21 into holes 40 of bosses 41 that extend upward along the interior of bottom 25 of base 14, so that pegs 34 and screws 38 retain support bracket 21 to base 14. Holes 39 may extend though bosses 21*c* (FIGS. 5 and 6) along the underside of wall 21*a* of support bracket 21 that abut top of bosses 41. Also, a central boss 21*d* (FIGS. 5 and 6) may downwardly extend from the underside of wall 21*a* adjacent and/or abutting the top of sealing member 30.

Vanes 16 are formed by a first circuit board 42 and a second circuit board 43 which intersect at the central axis 15 at a right angle, such that each of the circuit boards 42 and 43 provides two of the four vanes 16 extending outwards in opposite radial directions from central axis 15. Circuit boards 42 and 43 are thin, such as 0.060 inches in width, and have two opposing surfaces 17*a* and 17*b* which are preferably white in color. As circuit boards 42 and 43 form vanes 16, these same reference numerals 17*a* and 17*b* characterize the opposing surfaces 17*a* and 17*b* of each of the vanes 16 as described earlier. The electronics on the circuit boards 42 and 43 for controlling and operating LEDs 20 mounted on surfaces 17*a* and 17*b* will be described later in connection with FIGS. 9A and 9B. Circuit boards 42 and 43 have a top edge 42*a* and 43*a*, a bottom edge 42*b* and 43*b*, and an outer side edge 42*c* and 43*c*, respectively.

Figure 8A:
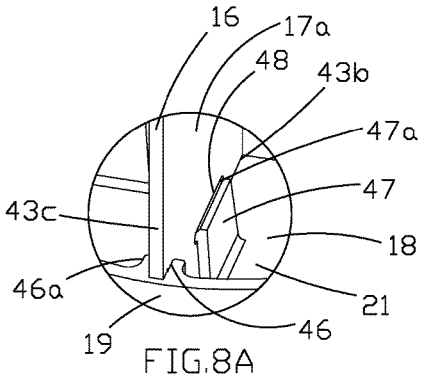
FIG. 8A is a fragmentary enlarged view taken within the circle marked "A" in FIG. 8.

Circuit board 42 has a slot 44 extending from its top edge 42*a* into which is received slot 45 of circuit board 43 extending from bottom edge 43*b* so that the circuit boards engage each other at a right angle with their top edges 42*a* and 43*a*, and bottom edges 42*b* and 43*b* in alignment as shown in FIG. 8. Circuit boards 42 and 43 further have two opposing bottom ends 42*d* and 43*d*, respectively, that are received in vertical slots (or channels) 46 along inwardly extending vertical portions 46*a* from the interior of circular wall 19, so that the lowest part of side edges 42*c* and 43*c* of circuit boards 42 and 43, respectively, extend upon the top of circular wall 19, as best shown in FIGS. 5, 8, and 8A. To retain circuit boards 42 and 43 when each engages their associated slots 46, four tabs 47 are provided which extend upward from upper surface 18 of support bracket 21 so that projections 47*a* at the upper end of such tabs 47 engage into slots 48 along the circuit boards.

Preferably prior to engagement of circuit boards 42 and 43 with each other using slots 44 and 45, the two bottom ends 42*d* of circuit board 42 are first received in two of slots 46, and two of tabs 47 are positioned alongside circuit board 42 so that their projections 47*a* snap into two of the slots 48 along circuit board 42 to lock circuit board 42 in place upon base 14. Next, slot 45 of circuit board 43 is positioned into slot 44 of circuit board 42 as described earlier, such that circuit boards 42 and 43 crisscross each other in an X shape (see FIG. 2), with two bottom ends 43*d* of circuit board 43 received in the other two of slots 46, and the other two of tabs 47 are positioned alongside circuit board 43 so that their projections 47*a* snap into two of the slots 48 along circuit board 43 to lock circuit board 43 in place upon base 14. When circuit boards 42 and 43 are fully engaged by tabs 47, the eight LEDs 20 mounted on each of surfaces 17*a* and 17*b* of the vanes 16 provided by such circuit boards are properly oriented in beacon 10 for illuminating lens 12, where slots 44 and 45 generally extend along central axis 15.

A connector 50 is provided at the end of wires 29 after passing from sealing member 30 upwards via one of slots 57 along the outer flange 21*b* of support bracket 21, as shown in FIG. 8. Such connector 50 provides conductors or leads from the five wires 29 that can make electrical contact with pads or pins along tab(s) 51 of circuit board 42 to electronics (FIG. 9A) when connector 50 engages such tab(s) 51. Tab(s)

51 extend along side edge 42*c* of one of the vanes 16 provided by circuit board 42. While two tabs 51 are shown in FIGS. 6 and 7, a single tab may be present, and also tab(s) may differ in size and shape from that shown depending on the connector 50 used. To retain connector 50 to circuit board 42, a clip 52 extends from connector 50 and engages a hole 53 along circuit board 42. Optionally, another hole 53*a* through circuit board 42, and a slot 53*b* through circuit board 43, are provided at the same height as hole 53 from base 14. An optional tie wrap (not shown) may then be used to loop through hole 53*a*, through slot 53*b* on either side of circuit board 42, and then tighten around connector 50 to provide an additional mechanism for retaining connector 50 engaged along circuit board 42 to avoid risk of disconnect of the connector 50 from circuit board 42. To complete the mechanical assembly, collimating lens 12 is mounted to base 14 to provide a dome of beacon 10 thereby fully enclosing circuit boards 42 and 43 therein upon base 14 so that light 22 from LEDs 20 mounted on the circuit boards can be projected to collimating lens 12.

The profile of the side edges 42*c* and 43*c* of the circuit boards 42 and 43, respectively, forming the vanes 16 can be selected to provide a desired passage of light from LEDs 20 to the collimating lens 12 for the particular application of the beacon. For example, side edges 42*c* and 43*c* of the circuit boards 42 and 43, respectively, may be contoured to provide an opening 54, which preferably forms a right or 90 degree angle disposed at or approximately 45 degree angle tilt, denoted as 55, with respect to central axis 15 as shown in FIG. 3. Such openings 54 along the vanes 16 provide for passage of light 22 from the LEDs 20 to collimating lens 12 in order to minimize or avoid dark or dimmed areas along the lens 12 that would be caused by blockage of LED light by vanes 16 if openings 54 were not present in light 23 from the beacon, such as shown in FIG. 4. Other angles than 90 degrees may be used with respect to central axis 15 depending on the height and/or diameter of lens 12 providing the dome of beacon 10. For example, opening 54 may be at a wider angle than 90 degrees when the height of lens 12 is taller than shown, or at a smaller angle than 90 degrees when lens 12 is of a larger diameter than shown. The opening 54 along each of the vanes 16 primarily allows propagation of light outwards from LEDs 20 mounted on two different vanes 16 on either side such vane, and any reflected LED light by surfaces of circuit boards when preferably white in color. Each of the vanes 16 may be considered as having a side edge 42*c* or 43*c* along an upper portion of the vane that continuously narrows in distance from central axis 15 (along a dimension normal to such central axis 15) as the outer edge approaches the height of the LEDs above base 14 until such height is reached, and then as the side edge continuously increases in distance from central axis 15 as the side edge extends further upwards along vane 16 from that height to at or near the top of the vane. Although the particular contour defining the shape of side edges 42*c* and 43*c* is shown, openings 54 along such side edges may be shaped differently so long as dark or dimmed areas along collimating lens 12 are avoided by a portion of LED light 22 being blocked by vanes 16.

Figure 13A:
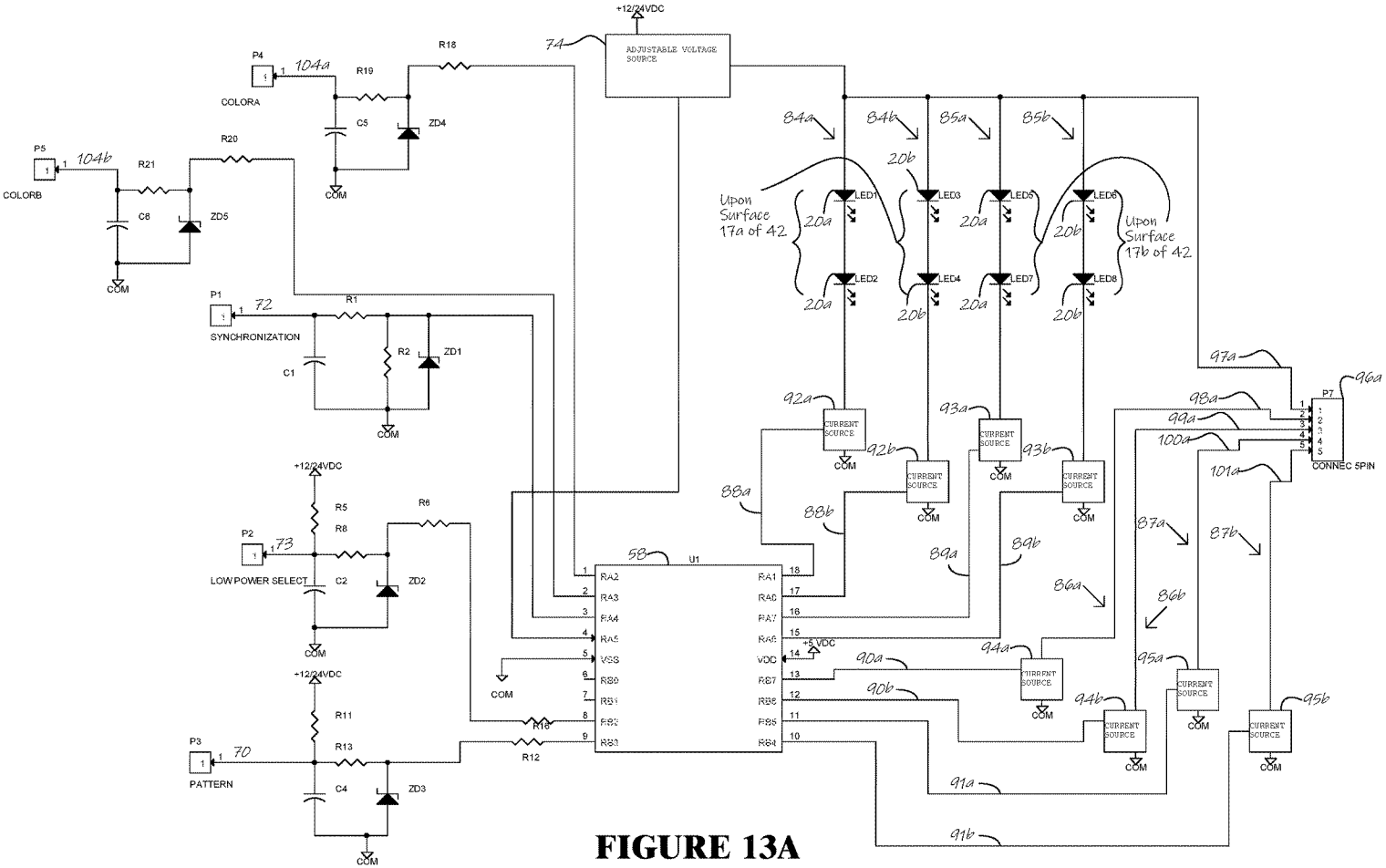
FIGS. 13A and 13B are two schematic diagrams of the electronics of the LED beacon of FIG. 1 in accordance with the embodiment of FIG. 12 to provide two different colors of light from the beacon, where
Figure 13B:
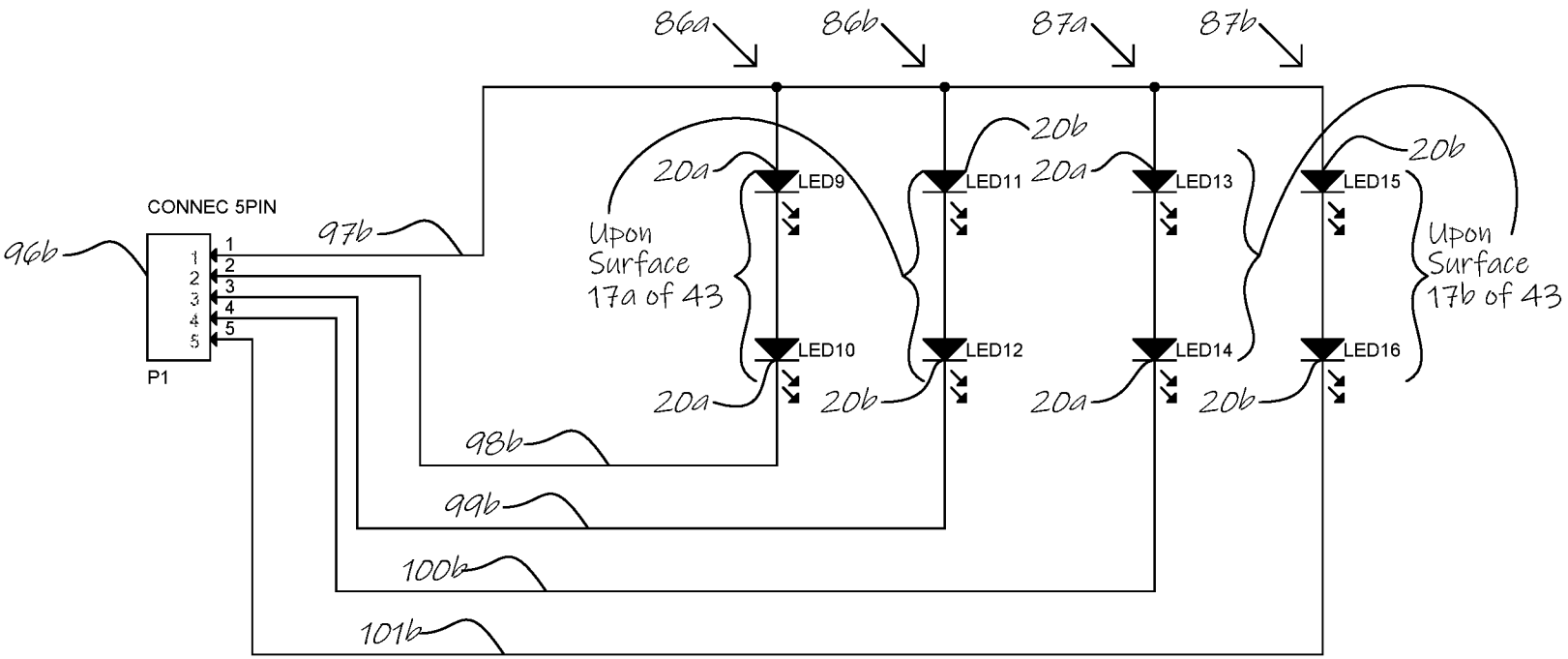
Figure 14:
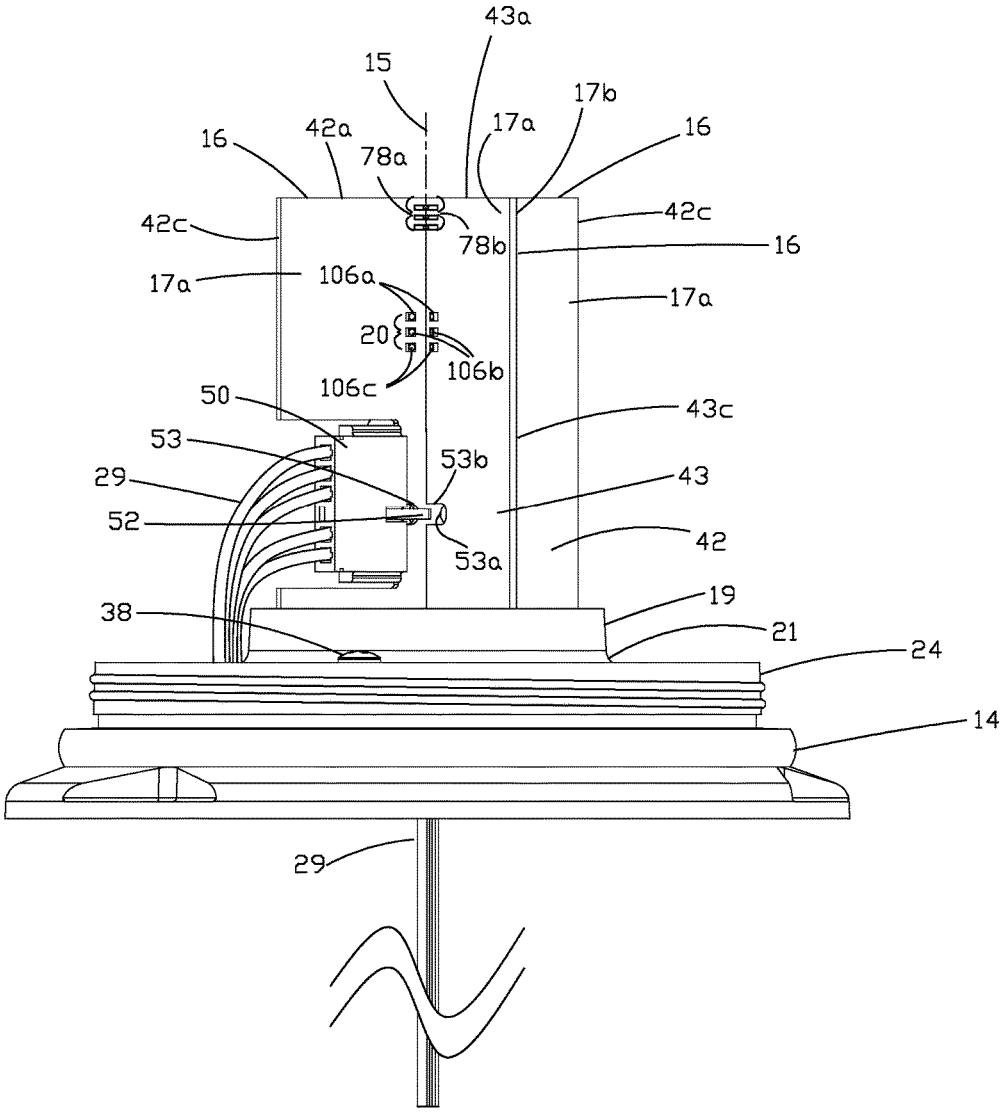
FIG. 14 is a side view of the LED beacon similar to FIG. 3 with the collimating lens removed showing an alternative profile of the vanes upon the base of the beacon.
Figure 15:
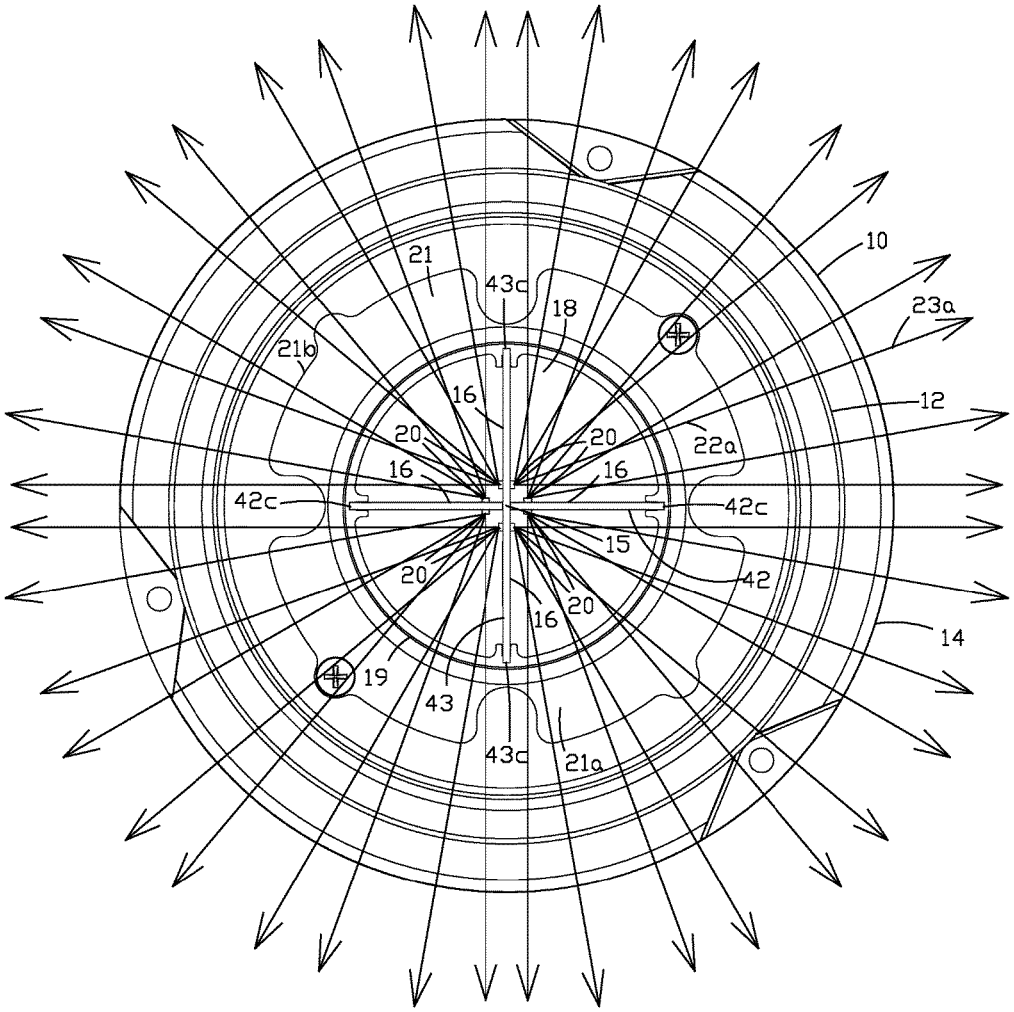
FIG. 15 is a horizontal sectional view similar to FIG. 4 depicting light rays showing the propagating of light from the LEDs disposed upon vanes of FIG. 14 within the beacon in 360 degrees.
Figure 16:
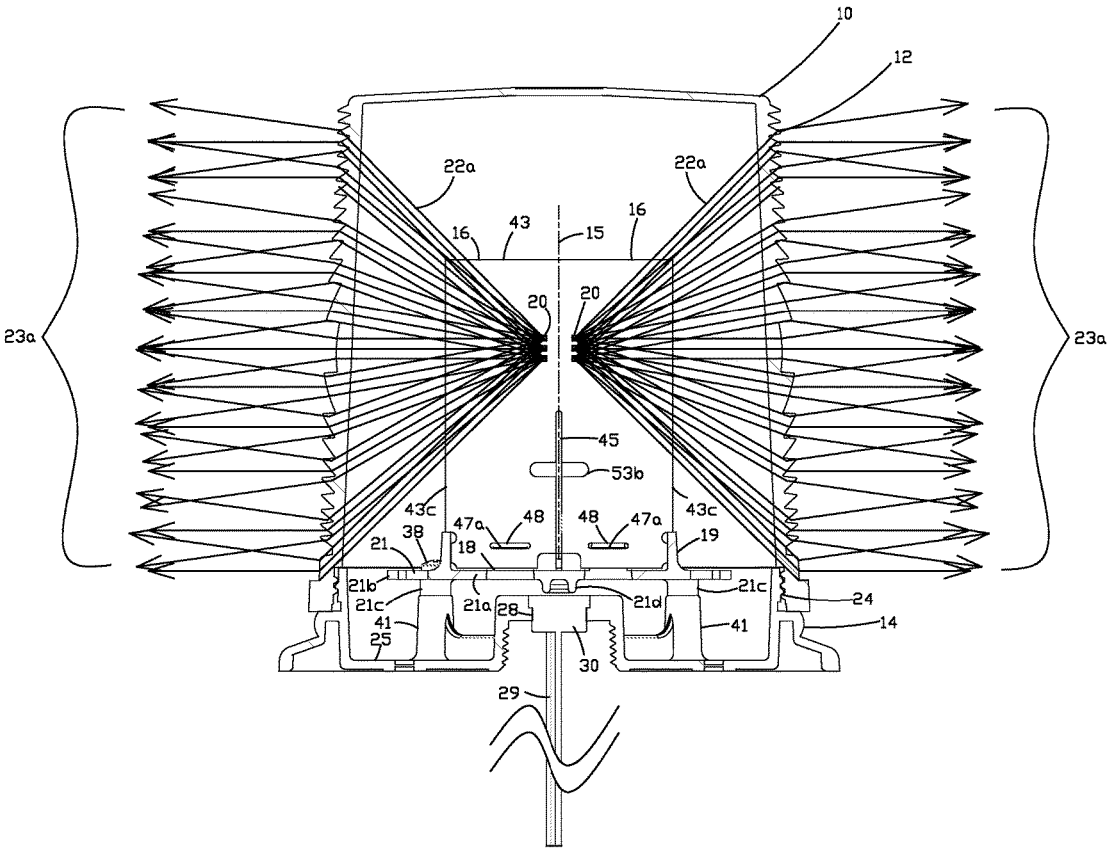
FIG. 16 is a vertical sectional view of the LED beacon similar to FIG. 5 along line 5-5 of FIG. 1 in the direction of the arrows at the end of the section line depicting light rays showing the propagating of light from the LEDs of the beacon of FIGS. 14 and 15.

In another example of the profile of the side edges 42*c* and 43*c* of the circuit boards 42 and 43, respectively, forming the vanes 16, no such openings 54 are present along the vanes 16, as shown along the vanes 16 of FIGS. 14, 15, and 16. The profile of side edges 42*c* and 43*c* extends along a dimension parallel to central axis 15 along a portion of vanes 16 from the lowest part that lies upon the top of circular wall 19 to top edges 42*a* and 43*a*, respectively, except for vane 16 having connector 50 which extends along such dimension along a portion of its side edge 42*c* above and below the uppermost and lowermost ones of notches or slots along circuit board 42 that form tab(s) 51. Thus, above the height of connector 50 in beacon 10, at least a portion of each of the outer side edges 42*c* and 43*c* of the circuit boards 42 and 43, respectively, forming vanes 16 extends a common distance from central axis 15 and extend linearly parallel to central axis 15. This can be useful for LED beacon 10 in a rotating mode having continuous sequential activation of four different sets of LEDs, where each set faces the same direction at one of four different angles 0, 90, 180, and 270 degrees, called herein quadrants, about the 360 degrees circumference of lens 12, as will be described latter below in connection with rotating mode enabled by electronics of FIGS. 10A and 10B, and FIGS. 13A and 13B. Thus in this example, light from each of sets of LEDs 20 when activated for one quadrant is minimized (or avoided) by blockage of vanes 16 in passing into adjacent quadrants, which can deter from the perception of rotation. While without openings 54 dimmed areas along lens 12 may occur by vanes 16 blockage when LEDs 20 are activated in solid on or flashing patterns, such can be a modest compromise in performance to obtain improved perception of rotation. The profile (e.g., shape) and radial distance of side edges 42*c* and 43*c* of the four vanes 16 from central axis 15 may be selected as desired to achieve a desired beacon 10 performance in its different modes of operation. FIG. 15 depicts LEDs 20 on the vanes 16 without openings 54 providing light 22*a* to collimating lens 12 which projects light 23*a* from beacon 10 when the LEDs are activated in solid on or flashing patterns.

The pair of vanes 16 formed by circuit board 43 symmetrically mirror each about central axis 15, while the pair of vanes 16 formed by circuit board 42 also symmetrically mirror each other above and below tab(s) 51 for engaging connector 50. Thus, the profile of each of the vanes above and below tab(s) 51 are preferably identical to each other about central axis 15.

The LEDs 20 mounted to circuit boards 42 and 43 may be light sources, such as for example, CREE XT-E or XQE LEDs, or a Lumileds LUXEON® Rebel or LUXEON® Z LEDs, and may emit white or any other color light as desired. Heat generated during the operation of the LEDs 20 when powered to generate light is readily dissipated to the ambient air within the beacon 10 by the orientation of the LEDs on opposite surfaces 17*a* and 17*b* of circuit boards 42 and 43. Such heat dissipated is further facilitated by the use of copper land areas on circuit boards 42 and 43 around each of the LEDs 20. Thus, secondary or additional heat conductive material, as used in LED beacons having a raised post with sides formed by circuit boards that mount LEDs along the post in order to facilitate transfer to heat as described in U.S. Pat. Nos. 8,662,702, and 8,840,268, are not needed in the beacon 10 of the present invention.

Figure 9A:
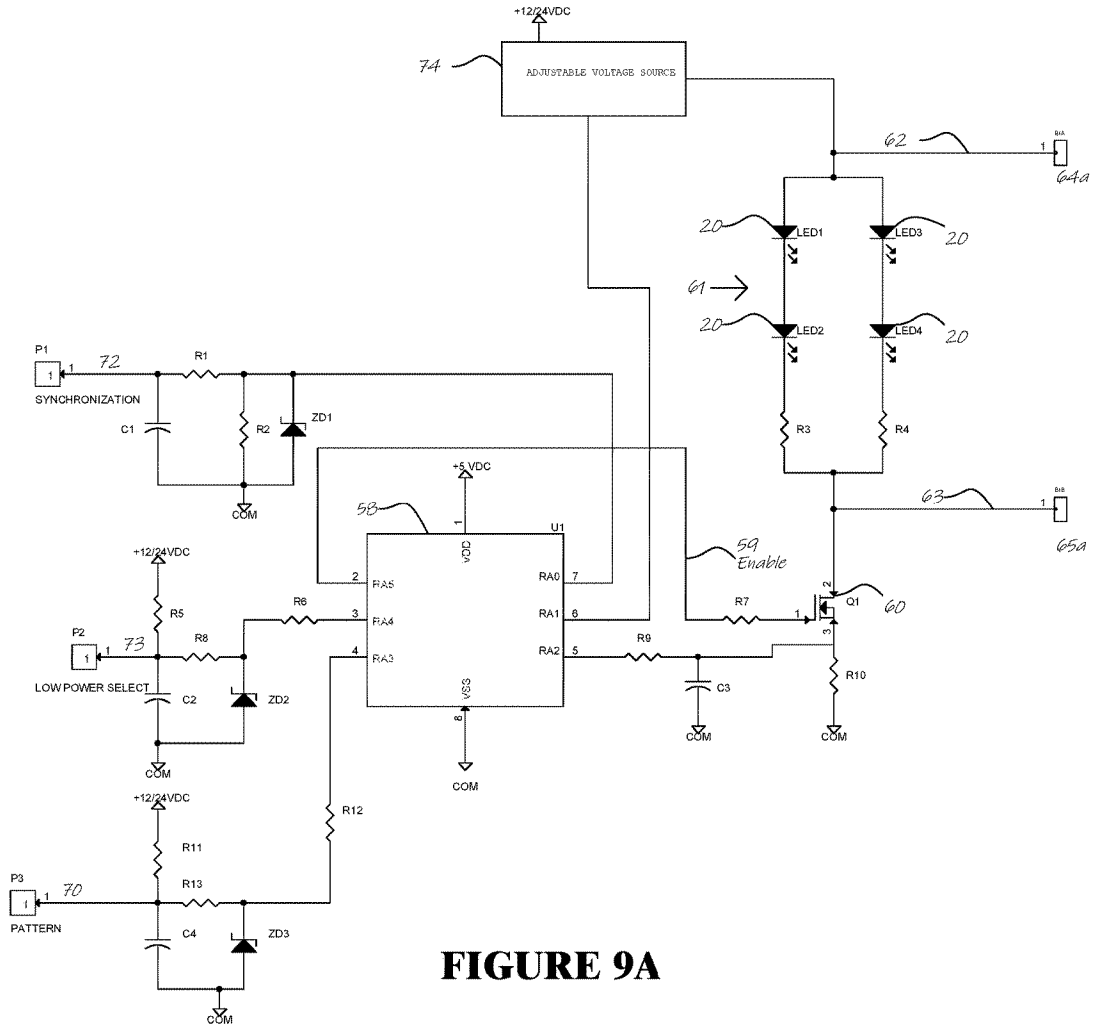
FIGS. 9A and 9B are two schematic diagrams of the electronics of the LED beacon of FIG. 1, where
Figure 9B:
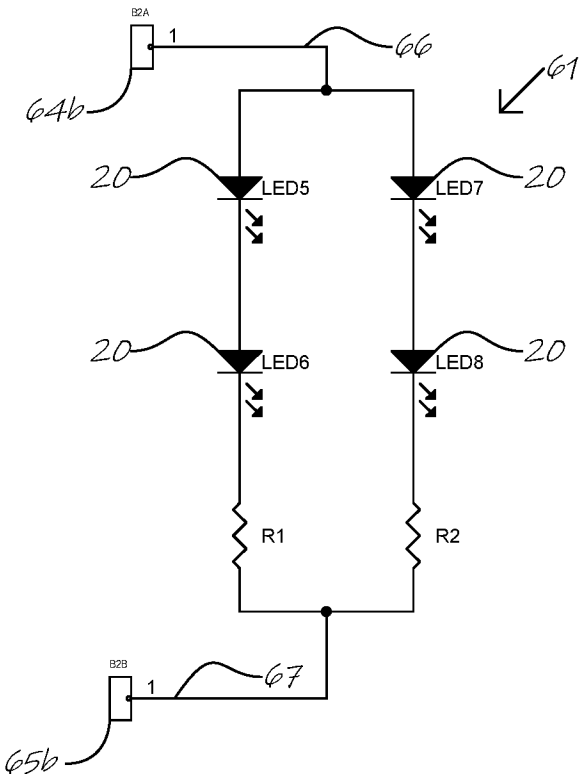

Referring to FIGS. 9A and 9B, the electronics for beacon 10 are shown, where the electronics provided on circuit board 42 are shown in FIG. 9A, and the electronics on circuit board 43 are shown in FIG. 9B. A controller 58 outputs signals along an enable line 59 which when high (on) switches, via a MOSFET 60, to drive current to LEDs 20 via a drive circuit 61 that extends along both circuit boards 42 and 43, and when the enable line 59 is low (off), the MOSFET 60 disables drive current in drive circuit 61. In order to extend the drive circuit 61 from circuit board 42 to circuit board 43, lines 62 and 63 from drive circuit 61 extend to pads 64*a* and 65*a*, respectively, in FIG. 9A, which connect to pad 64*b* and 65*b*, respectively, along circuit board 43 that extend to lines 66 and 67, respectively, to LEDs 20 on circuit board 43 in FIG. 9B.

As shown in FIG. 3, solder 68 and 69 is applied to electrically connect pads 64*a* and 64*b*, and connect pads 65*a* and 65*b*, respectively, after circuit boards 42 and 43 are both engaged together, either before or after their engagement to base 14 by slots 46 and tabs 47 of support bracket 21, but prior to circuit boards 42 and 43 being enclosed upon base 14 by collimating lens 12. Preferably pads 64*a*, 64*b*, 65*a*, and 65*b* are provided near top edges 42*a* and 43*a* of their respective circuit boards 42 and 43 so that the applied solder 68 and 69 additionally provides a mechanical connection between circuit boards 42 and 43 along the top of their integrated raised structure upon base 14. For purposes of illustration, electronics on surfaces 17*a* and/or 17*b* of circuit boards 42 and 43 are not shown in the figures. While such integrated raised structure is preferably provided by circuit boards 42 and 43 as shown in the figures, other raised structures providing multiple vanes 16 greater than two in number may be used which support LEDs 20 (or LEDS 20*a* and 20*b*) at a desired height with respect to lens 12 and are similarly mountable onto base 14.

The controller 58 operates in accordance with a program stored in its memory (ROM or RAM) to enable operation of beacon 10. For example, controller 58 may be a PIC microcontroller as shown in FIG. 9A, but other microcontroller, microprocessor, or programmable logic device may be used for controller 58 which can output signals to the drive circuit 61 for LEDs 20.

The pattern of operating LEDs 20 by controller 58 can be selected by a pattern select input or line 70. By placing on input 70 signals representative of one of different values, addresses, codes, or instructions, detectable by the controller 58, one of multiple different patterns of illumination by LEDs 20 and hence output light from beacon 10 may be selected, such as solid on, or flashing at different rates or patterns by controlling enable line 59. If no signal is provided along pattern select input 70, than a default pattern is used by controller 58 as set forth in memory of the controller. The present invention is not limited to any particular means for pattern input selection to controller 58. The flashing rate is in accordance with preset on and off intervals stored in memory of the controller 58. A clock in the controller 58 is used to measure each of the flash intervals.

A synchronization line 72 is provided to controller 58. When synchronization line 72 is switched from high to low, controller 58 resets the cycle of its internal clock. Such is useful when two different LED beacons 10 need to be synchronized to each other so that they flash at the same time, or alternate with each other.

Adjustable voltage source 74 represents a voltage converter to supply power to operate LEDs 20 (in accordance with the particular manufacturer specifications of the LEDs) when enabled at a high or lower power states. A low power select line 73 is provided to controller 58. When low power select line 73 is switched to high, the controller 58 sends a signal to voltage source 74 which changes the voltage to the drive circuit 61 so that illumination from the LED beacon 10 is in a lower power state, e.g., at or approximately 50% illumination is outputted by the LEDs 20. When low power select line 73 is low, the controller 58 disables the signal to adjustable voltage source 74 so that power output to the LEDs 20 returns to the high power state. Voltage source 74 may externally receive 12/24 VDC depending on the voltage source externally available to the LED beacon 10. Thus, the five wires 29 entering connector 50 provide ground, 12/24 VDC, pattern select line 70, synchronization line 72, and low power select line 73 to the electronics on the circuit boards.

To power controller 58, a voltage regulator (not shown) is also provided in the electronics on circuit board 42 to supply +5 VDC to the input VDD of controller 58. Such voltage regulator is powered by the same input line which provides 12/24 VDC to adjustable voltage source 74. The electronics on circuit board 42 and programming of controller 58 may be the same or similar as in mono-color Star Halo® LED Beacons, but with additional drive circuit 61 connections to LEDs 20 between the two circuit boards 42 and 43 as described above. The controller 58 starts operating LEDs 20 in accordance with a selected pattern, and synchronization (if any) upon applied power to the controller 58, i.e., when external 12/24 VDC is provided via one of wires 29.

While a single group of eight LEDs 20 are mounted on the vanes 16 provided by circuit boards 42 and 43, alternatively multiple groups of eight LEDs may be provided along the circuit boards, where each group is at a different height from the base 14 in order to provide additional or different illumination to collimating lens 12. Thus, a different pattern of illumination from the beacon is provided when the LEDs of one, or more than one, of the groups are in operation. Each additional group of LEDs may be separately driven by a different enable line by controller 58 in the same manner as described above for a single group of LEDs 20 along circuit boards 42 and 43. Such groups may be staggered equally or unequally up and down along the vanes 16 as desired.

Figure 10A:
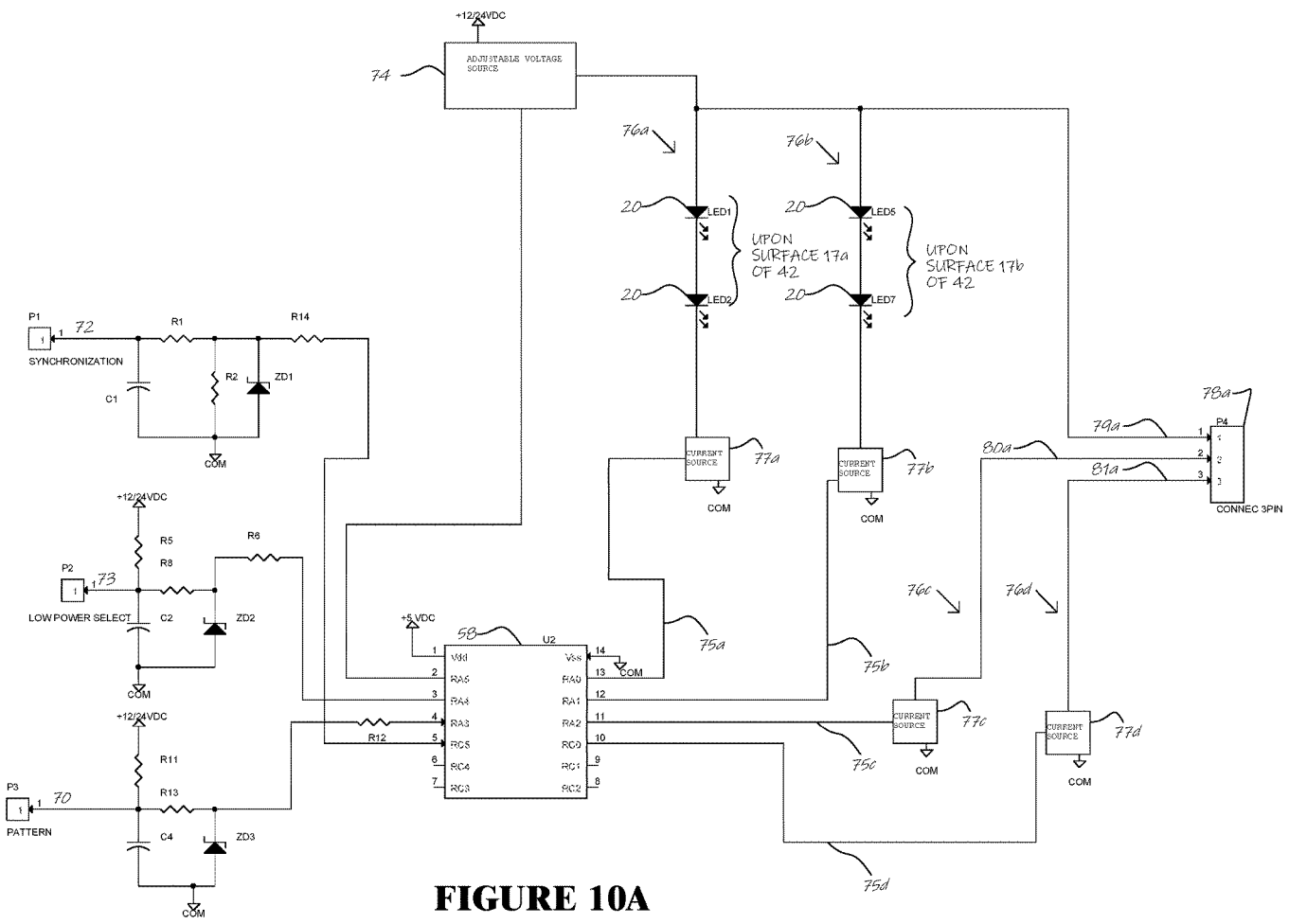
FIGS. 10A and 10B are two schematic diagrams of the electronics of the LED beacon of FIG. 1 in accordance with another embodiment, where
Figure 10B:
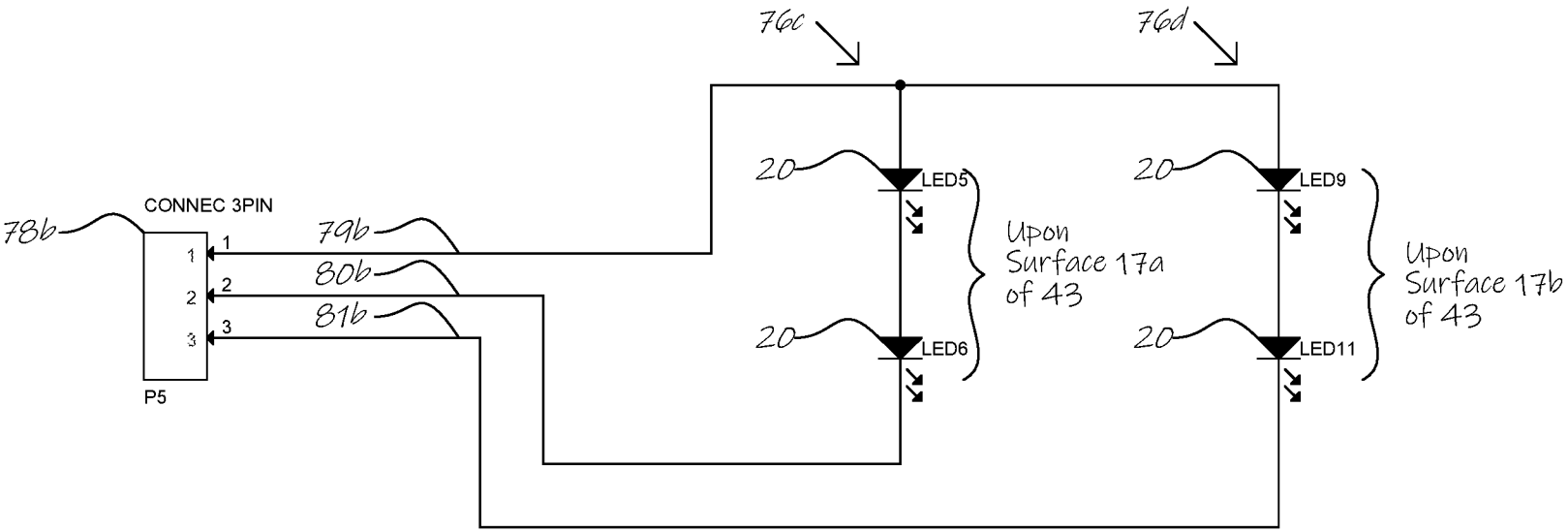

Referring to FIGS. 10A and 10B, the electronics for beacon 10 are shown in accordance with another embodiment having four drive circuits 76*a*, 76*b*, 76*c*, and 76*d* for different pairs of LEDs 20, where the electronics provided on circuit board 42 are shown in FIG. 10A, and the electronics on circuit board 43 are shown in FIG. 10B. The first drive circuit 76*a* is provided having both LEDs 20 on surface 17*a* of circuit board 42, the second drive circuit 76*b* is provided having both LEDs 20 on surface 17*b* of circuit board 42, the third drive circuit 76*c* is provided having both LEDs 20 on surface 17*a* of circuit board 43, and the fourth drive circuit 76*d* is provided having both LEDs 20 on surface 17*b* of circuit board 43. Thus each pair of LEDs 20 in the same one of drive circuits 76*a-d* are mounted on the same surface 17*a* or 17*b* of one of the circuit boards 42 or 43, and separated from each other by the other circuit board by being on different opposing vanes 16 of beacon 10 about central axis 15.

Figure 11:
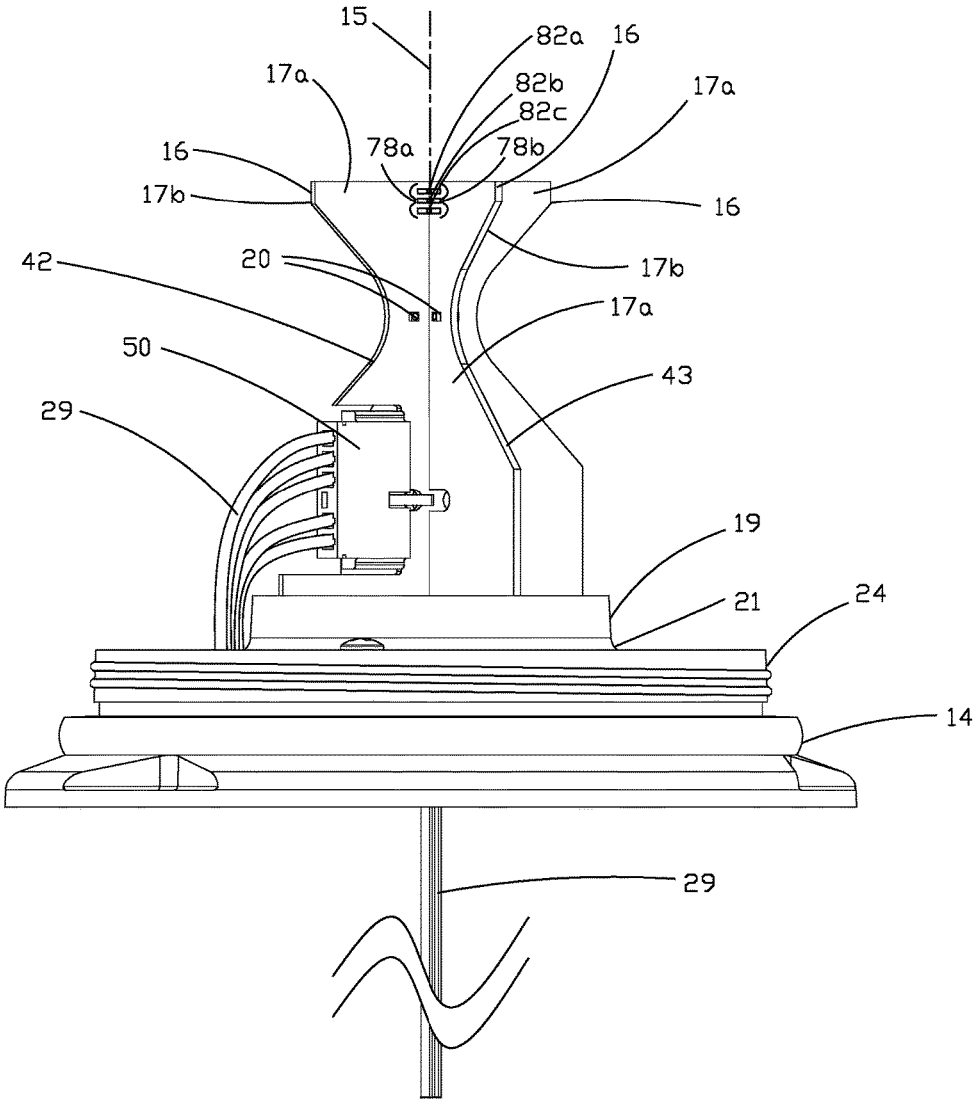
FIG. 11 is the same view as FIG. 3 showing an additional electrical connection between the two circuit boards in the embodiment of the electronics of FIGS. 10A and 10B.

Controller 58 outputs signals along an enable line 75*a* or 75*b* which when high (on) switches on a current source 77*a* or 77*b*, respectively, to drive current to LEDs 20 of drive circuit 76*a* or 76*b*, respectively, on circuit board 42, and when the enable line 75*a* or 75*b*, respectively, is low (off), the current source 77*a* and 77*b*, respectively, disables drive current in drive circuit 76*a* or 76*b*, respectively. Drive circuits 76*c* and 76*d* extend between circuit boards 42 and 43 using three connector pins or pads 78*a* provided on circuit board 42, which connect to three connector pins or pads 78*b* provided on circuit board 43, as shown in FIG. 11. Line 79*a* on circuit board 42 electrically connects, via solder 82*a*, with line 79*b* on circuit board 43 to provide power from voltage source 74 for drive circuits 76*c* and 76*d*. Line 80*a*, which extends from a current source 77*c* of drive circuit 76*c*, electrically connects, via solder 82*b*, to line 80*b* on surface 17*a* of circuit board 43 to the LEDs 20 of circuit 76*c*. Line 81*a*, which extends from a current source 77*d* of drive circuit 76*d*, electrically connects, via solder 82*c*, to line 81*b* on surface 17*b* of circuit board 43 to the LEDs 20 of circuit 76*d*. Thus, controller 58 outputs signals along an enable line 75*c* or 75*d* which when high (on) switches on current source 77*c* or 77*d*, respectively, to drive current to LEDs 20 of drive circuit 76*c* or 76*d*, respectively, that extend along surfaces 17*a* or 17*b*, respectively, of circuit board 43, and when the enable lines 75*c* or 75*d*, respectively, is low (off), switches current source 77*c* and 77*d*, respectively, to disable drive current in drive circuit 76*c* or 76*d*, respectively. Current sources 77*a-d* may each be the same as MOSFET 60 of FIG. 9A using same associated electronics enabling switching responsive to enable lines 75*a-d*, respectively.

By placing on pattern select input 70 signals representative of one of different values, addresses, codes, or instructions, detectable by the controller 58, one of multiple different patterns of illumination by LEDs 20 and hence output light from beacon 10 may be selected, such as solid on, or flashing at different rates or patterns by controlling enable lines 75*a*, 75*b*, 75*c*, and 75*d*. For example, if the signal on pattern select input 70 is detected by controller 58 for operating LED beacon 10 in a solid on mode, then all LEDs are activated using their enable lines 75*a*, 75*b*, 75*c*, and 75*d* until the signal on input 70 changes. However, if the signal on pattern select input 70 is detected by controller 58 for operating LED beacon 10 in a flash mode, then all LEDs 20 are periodically activated via output along their enable lines 75*a*, 75*b*, 75*c*, and 75*d* at a desired flash rate. The flashing rate is in accordance with preset on and off intervals stored in memory of the controller 58, such as every 0.5 seconds. A clock in the controller 58 is used to measure each of the flash intervals.

If the signal on pattern select input or line 70 is detected by controller 58 for operative LED beacon 10 in a rotating mode, the drive circuits 76*a*, 76*c*, 76*b*, and 76*d* are continuously sequentially activated by controller 58 so that the light from beacon 10 appears to be traveling or moving in a rotating pattern. For example, the following states 1-4 are repeated by controller 58: (1) enable line 75*a* is high to enabled drive circuit 76*a* with LEDs 20 on surface 17*a* of circuit board 42 and enable lines 75*b*, 75*c*, and 75*d* are low; (2) enable line 75*c* is high to enabled drive circuit 76*c* with LEDs 20 on surface 17*a* of circuit board 43 and enable lines 75*a*, 75*b*, and 75*d* are low; (3) enable line 75*b* is high to enable drive circuit 76*b* with LEDs 20 on surface 17*b* of circuit board 42 and enables lines 75*a*, 75*c*, and 75*d* are low; and (4) enable line 75*d* is high to enable drive circuit 76*d* with LEDs 20 on surface 17*b* of circuit board 43 and enable lines 75*a*, 75*b*, and 75*c* are low. The time intervals between successive states may be 0.5 seconds, but other time intervals may be used as stored in memory of controller 58 for selection by pattern select line 70. Thus, the perception of rotation is enabled by continuous sequential activation of each of four different sets of two LEDs 20 operated using enable lines 75*a,c,b,d*, where each set faces the same direction at one of four angles of 0, 90, 180, and 270 degrees about the 360 degrees circumference of lens 12. Each of the four sets of two LEDs 20 comprises LEDs 20 along two different vanes 16 that extend in opposite directions from central axis 15, but face the same common direction at either 0, 90, 180, or 270 degrees.

Other or different patterns can be provided by separately or simultaneous enabling drive circuits 76*a-d* as desired by programming controller 58. Other than the additional patterns available by enabling drive circuits 76*a-d* as described above, the operation of controller 58 is the same as described earlier in connection with FIGS. 9A and 9B.

Figure 12:
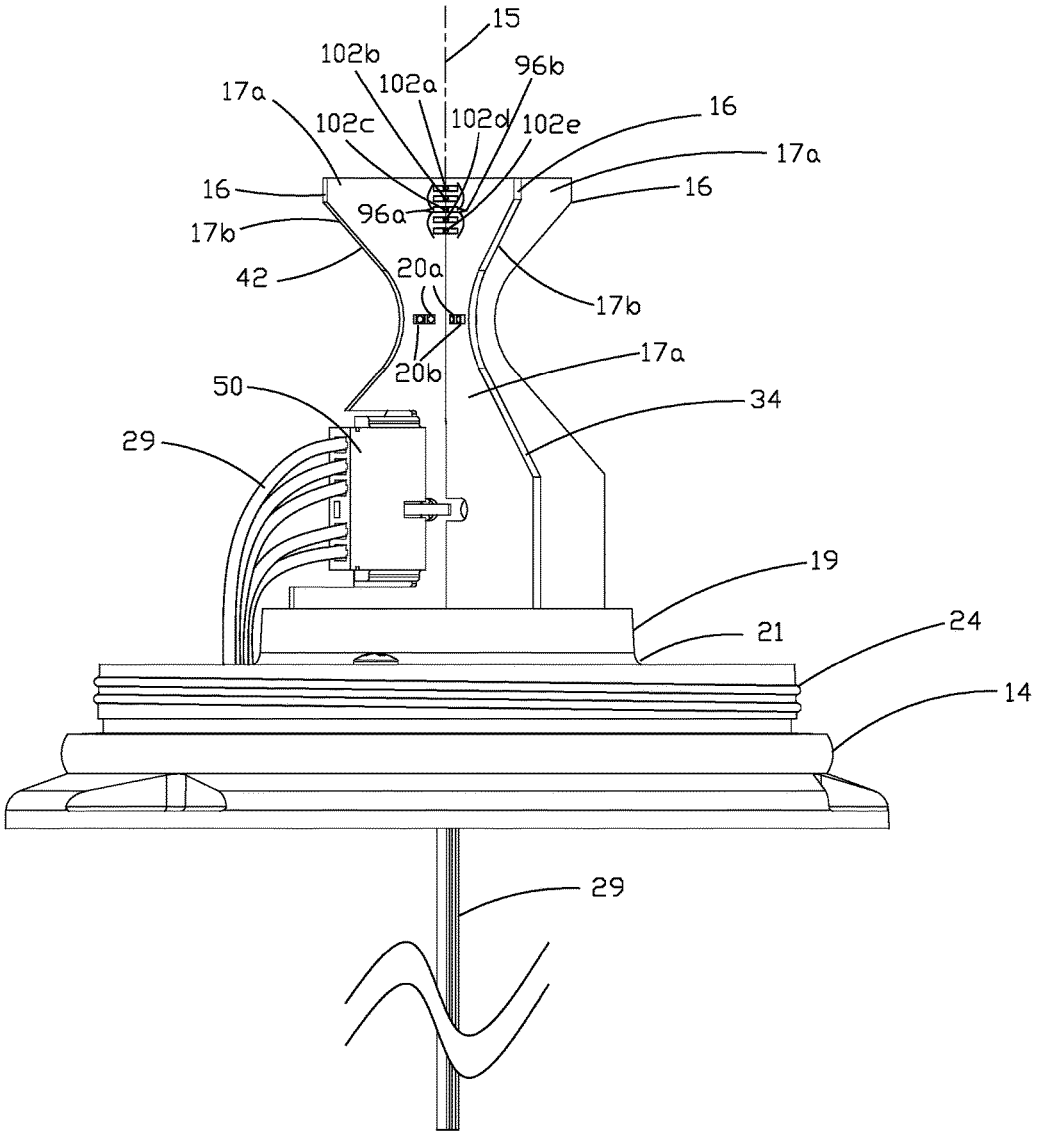
FIG. 12 is the same view as FIG. 3 of a further embodiment of the LED beacon on FIG. 1 providing two different colors of light, in which two LEDs, each emitting a different one of such two colors, are provided on each of the two opposing surfaces of each vane.

Referring to FIGS. 12, 13A, and 13B, a further embodiment of LED beacon 10 is shown, which is the same as that described above for FIGS. 1-8, except that a pair of LEDs (or LED emitters) 20*a* and 20*b*, each for emitting a different color of light are mounted on surfaces 17*a* and 17*b* of each vane 16 provided by circuit boards 42 and 43. LED beacon 10 thus has multicolor operation having LEDs 20*a* and 20*b* providing light of two different Colors A and B, for e.g., red and green, or red and blue, with collimating lens 12 providing the dome of beacon 10 being of clear plastic molded material. The LEDs 20*a* and 20*b* are at the same height along vanes 16 from base 14 and operate in the same manner as LEDs 20 of FIGS. 1-8 to provide light 22 to collimating lens 12. While LEDs 20*a* are mounted closer to central axis 15 than LEDs 20*b*, LEDs 20*a* and 20*b* are both considered as being in proximity to (or adjacent) the focal point 13 along the central axis, so that light from LEDs 20*a* or 20*b* when activated will be approximately in focus with collimating lens 12 for projection as collimated light from the beacon.

Electronics shown in FIGS. 13A and 13B enable the LEDs 20*a* and 20*b* of different color to be selectively activated by controller 58. Four drive circuits 84*a*, 85*a*, 86*a*, and 87*a* are provided each for a different pair of LEDs 20*a*, and four drive circuits 84*b*, 85*b*, 86*b*, and 87*b* are provided each for a different pair of LEDs 20*b*. The first drive circuit 84*a* is provided having the two LEDs 20*a* on surface 17*a* of circuit board 42, the second drive circuit 84*b* is provided having the two LEDs 20*b* on surface 17*a* of circuit board 42, the third drive circuit 85*a* is provided having the two LEDs 20*a* on surface 17*b* of circuit board 42, and the fourth drive circuit 85*b* is provided having the two LED 20*b* on surface 17*b* of circuit board 42. The fifth drive circuit 86*a* is provided having the two LEDs 20*a* on surface 17*a* of circuit board 43, the sixth drive circuit 86*b* is provided having the two LEDs 20*b* on surface 17*a* of circuit board 43, the seventh drive circuit 87*a* is provided having the two LEDs 20*a* on surface 17*b* of circuit board 43, and the eighth drive circuit 87*b* is provided having the two LED 20*b* on surface 17*b* of circuit board 43. Thus each pair of LEDs 20*a* or 20*b* in the same one of drive circuits 84*a*, 84*b*, 85*a*, 85*b*, 86*a*, 86*b*, 87*a*, or 87*b* are mounted on the same surface 17*a* or 17*b* of one of the circuit boards 42 or 43, and separated from each other by the other circuit board by being on different opposing vanes 16 of beacon 10.

Controller 58 outputs signals along an enable line 88*a*, 88*b*, 89*a*, 89*b*, 90*a*, 90*b*, 91*a*, and 91*b* which when high (on) switches on a current source 92*a*, 92*b*, 93*a*, 93*b*, 94*a*, 94*b*, 95*a*, and 95*b*, respectively, to drive current to their respective LEDs 20*a* or 20*b* to emit light via drive circuit 84*a*, 84*b*, 85*a*, 85*b*, 86*a*, 86*b*, 87*a*, or 87*b*, respectively, and when the enable lines 88*a*, 88*b*, 89*a*, 89*b*, 90*a*, 90*b*, 91*a*, or 91*b*, respectively, is low (off), switches the current source 92*a*, 92*b*, 93*a*, 93*b*, 94*a*, 94*b*, 95*a*, and 95*b*, respectively, to disable drive current in drive circuit 84*a*, 84*b*, 85*a*, 85*b*, 86*a*, 86*b*, 87*a*, or 87*b*, respectively. Drive circuits 86*a*, 86*b*, 87*a*, and 87*b* extend between circuit boards 42 and 43 using five connector pins or pads 96*a* provided on circuit board 42, which connect to five connector pins or pads 96*b* provided on circuit board 43, as shown in FIG. 12. Line 97*a* on circuit board 42 electrically connects with line 97*b*, via solder 102*a*, to circuit board 43 to connect voltage source 74 to drive circuits 86*a*, 86*b*, 87*a*, and 87*b*. Lines 98*a*, 99*a*, 100*a*, and 101*a* extend from current sources 94*a*, 94*b*, 95*a*, and 95*b*, respectively, to electrically connect, via solder 102*b*, 102*c*, 102*d*, and 102*e*, respectively, to lines 98*b*, 99*b*, 100*b*, and 101*b*, respectively to LEDs 20*a* or 20*b* of drive circuits 86*a*, 86*b*, 87*a*, and 87*b*, respectively. Current sources 92*a*, 92*b*, 93*a*, 93*b*, 94*a*, 94*b*, 95*a*, and 95*b* may each be the same as MOSFET 60 of FIG. 9A using same associated electronics enabling switching responsive to enable lines 88*a*, 88*b*, 89*a*, 89*b*, 90*a*, 90*b*, 91*a*, and 91*b*, respectively.

To enable each Color A and Color B, two inputs 104*a* and 104*b* are provided to controller 58 to select one of Color A of LEDs 20*a* or Color B LEDs 20*b*, respectively, according to the selected pattern via pattern select input 70 to controller 58. Illumination may be selected utilizing light of Color A or Color B, or both, responsive to inputs 104*a* and/or 104*b* being high (enabled) or low (disabled). Thus, one of multiple different patterns of illumination by LEDs 20*a* and/or 20*b* and hence output light from beacon 10 may be selected, such as solid on or flashing at different rates or patterns of all LEDs 20*a* of Color A and/or all LEDs 20*b* of Color B, by controller 58 controlling enable lines 88*a*, 89*a*, 90*a*, 91*a* and/or enable lines 88*b*, 89*b*, 90*b*, and 91*b*, respectively, to go high or low at the same time in accordance with the selected illumination. Further, if Color A is selected and the signal on pattern select input 70 is detected by controller 58 for operative LED beacon 10 in a rotating mode, the drive circuits 84*a*, 86*a*, 85*a*, and 87*a* are continuously sequentially activated by controller 58 in the same manner as drive circuits 76*a*, 76*c*, 76*b*, and 76*d*, respectively, are enabled and disabled to provide such rotating mode as described earlier. Similarly, if Color B is selected and the signal on pattern select input 70 is detected by controller 58 for operative LED beacon 10 in a rotating mode, the drive circuits 84*b*, 86*b*, 85*b*, and 87*b* are continuously sequentially activated by controller 58 in the same manner as drive circuits 76*a*, 76*c*, 76*b*, and 76*d*, respectively, are enabled and disabled to provide such rotating mode as described earlier.

As shown in FIG. 12, five wires 29 are provided to connector 50, but there are seven inputs to the electronics shown in FIGS. 13A and 13B of Color A input 104*a*, Color B input 104*b*, ground, 12/24 VDC, pattern select line 70, synchronization line 72, and low power select line 73. In such case, Color A input 104*a* and Color B input 104*b* are each tied to the input 12/24 VDC of adjustable voltage source 74, and their respective zener diodes ZD4 and ZD5, and resistors shown in series with input 104*a* and 104*b*, clamps the voltage when present to no more than 5VDC for input to controller 58. Thus, the line used to provide power to the beacon 10 needed to operate the LEDs also enables selection of Color A input 104*a* and/or Color B input 104*b*, and a separate input line for 12/24 VDC is not needed. The five wires 29 to connector 50 are then Color A input 104*a*, Color B input 104*b*, ground, and selected two of either pattern select line 70, synchronization line 72, or low power select line 73, depending on the particular application of the LED beacon 10 providing dual color selectable operation. Typically, such two selected lines are pattern select line 70 and synchronization line 72, and lower power select line 73 is not used to enable lower power. Alternatively, seven wires 29 are provided to connector 50 which connect then to the seven inputs of the electronics of FIGS. 13A and 13B.

Other than the additional patterns and Colors A and B available by using drive circuits 84*a*, 84*b*, 85*a*, 85*b*, 86*a*, 86*b*, 87*a*, and 87*b*, the operation of controller 58 is the same as described earlier in connection with FIGS. 9A and 9B. The electronics of the multicolor embodiment of LED beacon 10 on circuit board 42 and programming of controller 58 may be the same or similar as in dual-color Star Halo® LED Beacons, but with additional drive circuits 86*a*, 86*b*, 87*a*, and 87*b* connections between the two circuit boards 42 and 43 as described above. LEDs 20 providing light of more than two colors may also be similarly provided along each of the vanes 16 with additional drive circuits, enables lines to controller 58, and electrical connections between the circuit boards 42 and 43. As in FIG. 9A, the controller 58 of FIGS. 10A and 13A may be a PIC microcontroller, but other microcontroller, microprocessor, or programmable logic device operating in accordance with a program stored in its memory (ROM or RAM) may be used for controller 58 which can output signals to the drive circuits for LEDs 20 (FIGS. 10A-10B), or LEDs 20*a* and 20*b* (FIGS. 13A-13B). Although not shown in FIGS. 10A, and 13A, a voltage regulator powered by the 12/24 VDC input is also provided on circuit board 42 to supply +5 VDC to the input VDD of controller 58.

Referring to FIGS. 14, 15, and 16, a beacon 10 with three groups 106*a*, 106*b*, and 106*c* of LEDs 20 in proximity to the central axis 15 are mounted on the vanes 16 each at different height from base 14 and provide light 22*a* to lens 12 for projection as light 23*a* from beacon 10. Each of the groups 106*a-c* has eight LEDs 20, where a stack of three LEDs 20, one from each of groups 106*a-c*, are mounted on each of surfaces 17*a* and 17*b* of each of the vanes 16. The additional LEDs on the vanes 16 can provide extra illumination from beacon 10 than the beacon with eight LEDs of FIGS. 1-8. Preferably, the LEDs 20 of groups 106*a-c* provide light of the same color. Group 106*b* is at same height as that of the LEDs 20 of the beacon shown in FIGS. 3 and 11, and groups 106*a* and 106*c* are equally spaced a different height above and below, respectively, from group 106*b*.

The electronics of the beacon 10 of FIGS. 14-16 is the same as that shown in FIGS. 10A and 10B, but where drive circuits 76*a*, 76*b*, 76*c*, and 76*d* are each expanded to have in parallel with their pair of LEDs 20 an additional two pairs of LEDs 20 in accordance with the surface 17*a* or 17*b* and circuit board 42 or 43 associated with the drive circuit. Thus, each drive circuit 76*a*, 76*b*, 76*c*, and 76*d* when enabled simultaneously drives six LEDs 20 (a pair from each of the three group 106*a-c*) on one of the surfaces 17*a* or 17*b* of one of the circuit boards 42 or 43 associated with the drive circuit to provide light in the same direction towards lens 12, but along two of the vanes 16 extending in opposite directions from central axis 15. Like in FIG. 11, drive circuits 76*c* and 76*d* extend between circuit boards 42 and 43 using three connector pins or pads 78*a* provided on circuit board 42, which connect by solder to three connector pins or pads 78*b* provided on circuit board 43. The operation of the beacon 10 of FIGS. 14-16 is the same as described earlier for the beacon 10 of FIG. 11 in connection with FIGS. 10A and 10B.

As the upper and lower groups 106*a* and 106*c* of LEDs 20 are slightly above and below, respectively, the ideal height for focusing onto lens 12 at which the middle group 106*b* of LEDs are mounted, light from the upper and lower groups 106*a* and 106*c* of LEDs 20 is less collimated than light from the middle group 106*b*, as depicted by light 22*a* in FIG. 16 diverging or converging. While FIGS. 14 and 16 show groups 106*a-c* equally spaced apart from each other along the height from base 14, groups of LEDs 20 may be equally or unequally staggered up and down along the vanes 16 as desired in proximity to the central axis 15. Further, two groups, or more than the three groups of LEDs 20 may be optionally provided to obtain the desired illumination to lens 12 for output from beacon 10. Further, while groups 106*a-c* of LEDs 20 of FIGS. 14 and 16 are shown on vanes 16 without openings 54, such groups 106*a-c* may also be provided on beacon 10 with vanes 16 having openings 54.

While an integrated raised structure in beacon 10 is preferably provided by circuit boards 42 and 43 as shown in the figures, other raised structures providing multiple vanes 16 of three or more in number, such as 3 to 6, radially extending from central axis 15 may be used which are mountable onto base 14 and similarly support LEDs 20 (or LEDS 20*a* and 20*b*) on surfaces 17*a* and 17*b* of each of the vanes.

From the foregoing description, it will be apparent that there has been provided improved LED beacons. Variations and modifications in the herein described LED beacons within the scope of the invention will undoubtedly suggest themselves to those skilled in the art. Accordingly, the foregoing description should be taken as illustrative and not in a limiting sense.

The invention claimed is:

1. An LED beacon comprising:

a base;

a lens providing a dome over said base;

four vanes upon said base extending radially outward from a central axis which lies perpendicular to an upper surface of said base;

a plurality of LEDs; and each of said vanes has two opposing surfaces and upon each of said two opposing surfaces is mounted at least one of said plurality of LEDs in proximity to said central axis to convey light outwards from said beacon via said lens.

2. The beacon according to claim 1 wherein a different one of said plurality of LEDs is mounted upon each of said two opposing surfaces of each of said vanes.

3. The beacon according to claim 1 wherein said plurality of LEDs provide different colors of lights, and at least one of said LEDs associated with each of said different colors are mounted upon each of said two opposing surfaces of each of said vanes, in order to provide said different colors of light to said lens by selective activation of the LEDs associated with each of said different colors.

4. The beacon according to claim 1 wherein said vanes are formed by two circuit boards upon said base that intersect each other at a right angle at said central axis, in which each of said circuit boards provides two of said vanes extending outwards in opposite directions from said central axis.

5. The beacon according to claim 4 further comprising wires extending via said base for connection to one of said vanes associated with a first of said circuit boards to enable operation of electronics along said first of said circuit boards and the LEDs disposed thereupon, and a second of said circuit boards has electronics electrically connected to said electronics on said first of said circuit boards to enable operation of said electronics on said second of said circuit boards and the LEDs disposed thereupon.

6. The beacon according to claim 1 wherein said plurality of LEDs when activated convey light in 360 degrees to said lens to substantially cover said lens along a height thereof from said base.

7. The beacon according to claim 1 wherein said plurality of LEDs are mounted upon each of said two opposing surfaces of each of said vanes at a common height from said base which is approximately midway along a height of said lens from said base.

8. The beacon according to claim 7 wherein said lens is a collimating lens, and said common height is in accordance with a focal point of said collimating lens.

9. The beacon according to claim 1 further comprising a controller enabling said plurality of LEDs to output light in multiple modes of at least solid on, flashing and rotating patterns along a 360 degree extent of said lens upon said base for projection from said beacon via said lens.

10. The beacon according to claim 1 further comprising a controller for controlling operation of said plurality of LEDs to selectively enable said LEDs to output light in multiple modes comprising at least a first mode of solid on, and a second mode of a flashing pattern.

11. The beacon according to claim 10 wherein said multiple modes further comprise a third mode of continuously sequentially activating four different sets of said LEDs, wherein each of said sets face a different direction at 0, 90, 180, and 270 degrees, respectively, about said central axis, so as to provide a rotating pattern of light from said beacon, wherein each of said sets of LEDs comprises ones of said LEDs along two different ones of said vanes that extend in opposite directions from said central axis but face a common direction at one of 0, 90, 180, and 270 degrees about said central axis.

12. The beacon according to claim 1 wherein each of said vanes has an outer side edge that extends along a dimension generally parallel to said central axis along at least a portion of the vane starting lower than a height of the LEDs from said base to a top of the vane.

13. The beacon according to claim 1 wherein each of said vanes has an outer side edge having a profile along a portion thereof as the vane extends upwards from said base that continuously narrows in distance from said central axis as the side edge approaches a selected height from said base until said selected height, and then the side edge continuously increases in distance from said central axis as said side edge extends further upwards along the vane from said selected height, in which said selected height is associated with at least said ones of said LEDs disposed at said height.

14. The beacon according to claim 1 wherein each one of said vanes has an outer side edge providing an opening enabling passage of light from the LEDs mounted on at least two other ones said vanes on either side said one of said vane.

15. The beacon according to claim 1 wherein said LEDs are in a plurality of groups in which each of said groups of said LEDs is mounted along each of said two opposing surfaces of said vanes at a height different from said base than other of said groups of said LEDs.

16. The beacon according to claim 1 wherein each of said two opposing surfaces of each of said vanes is mounted at least one of said plurality of LEDs, and two or more of said LEDs are at different heights from said base.

17. An optical system for an LED beacon comprising:

four vanes extending radially outward from a central axis, said vanes being formed by two circuit boards upon said base that intersect each other at a right angle, in which each of said circuit boards provides two of said vanes extending outwards in opposite directions; and each of said vanes has two opposing surfaces and upon each of said two opposing surfaces is mounted one or more LEDs to convey light outwards from said beacon.

18. The optical system according to claim 17 wherein said one or more LEDs represent a plurality of LEDs providing different colors of lights, and at least one of said LEDs associated with each of said different colors are mounted upon each of said two opposing surfaces of each of said vanes in order to provide said different colors of light by selective activation of LEDs associated with each of said different colors.

19. A method for providing an LED beacon comprising the steps of:

mounting four vanes upon a base extending radially outward from a central axis which lies perpendicular to an upper surface of said base;

providing on each of two opposing surfaces of said vane one or more LEDs emitting one or more different colors of light in proximity to said central axis; and selectively activating said LEDs to output light in each of said one or more colors via a lens that extends around said vanes.

20. The beacon according to claim 19 wherein said mounting step further comprises the step of forming said vanes using two circuit boards upon said base that intersect each other at a right angle, in which each of said circuit boards provides two of said vanes extending outwards in opposite directions.

* * * * *